US007775875B2

(12) United States Patent
Nguyen et al.

(10) Patent No.: US 7,775,875 B2
(45) Date of Patent: Aug. 17, 2010

(54) GAMING METHODS AND SYSTEMS

(75) Inventors: Binh T. Nguyen, Reno, NV (US); Bryan Wolf, Reno, NV (US); Craig Paulsen, Reno, NV (US)

(73) Assignee: IGT, Reno, NV (US)

( * ) Notice: Subject to any disclaimer, the term of this patent is extended or adjusted under 35 U.S.C. 154(b) by 1521 days.

(21) Appl. No.: 11/109,527

(22) Filed: Apr. 18, 2005

(65) Prior Publication Data

US 2006/0234791 A1 Oct. 19, 2006

(51) Int. Cl.
*A63F 9/24* (2006.01)

(52) U.S. Cl. ..... 463/22; 463/16; 463/17; 463/18; 463/19; 463/20; 463/26; 463/27; 463/28; 463/40; 463/42

(58) Field of Classification Search ..... 463/1–45
See application file for complete search history.

(56) References Cited

U.S. PATENT DOCUMENTS 5,042,809 A * 8/1991 Richardson ..... 463/18
5,324,035 A 6/1994 Morris et al.
5,779,549 A 7/1998 Walker et al.
6,220,961 B1 * 4/2001 Keane et al. ..... 463/16
6,241,606 B1 * 6/2001 Riendeau et al. ..... 463/17
6,409,602 B1 6/2002 Wiltshire et al.
6,419,583 B1 * 7/2002 Crumby et al. ..... 463/42
6,533,664 B1 * 3/2003 Crumby ..... 463/42
6,648,755 B1 * 11/2003 Luciano et al. ..... 463/17
7,515,718 B2 4/2009 Nguyen et al.
2002/0039917 A1 * 4/2002 Armstrong et al. ..... 463/16
2004/0176167 A1 * 9/2004 Michaelson et al. ..... 463/42
2004/0185931 A1 * 9/2004 Lowell et al. ..... 463/17
2004/0215566 A1 * 10/2004 Meurer ..... 705/43
2004/0248651 A1 * 12/2004 Gagner ..... 463/42
2006/0111168 A1 5/2006 Nguyen et al.

OTHER PUBLICATIONS

U.S. Appl. No. 10/995,636, filed Nov. 22, 2004, Nguyen et al.
U.S. Appl. No. 11/078,966, filed Mar. 10, 2005, Nguyen et al.
MX Office Action dated Mar. 27, 2009 issued in Mexican National Phase PCT Patent Application No. 06/04282 7 pp.

* cited by examiner

*Primary Examiner*—Ronald Laneau
*Assistant Examiner*—Justin Myhr
(74) *Attorney, Agent, or Firm*—Weaver Austin Villeneuve & Sampson LLP

(57) ABSTRACT

Disclosed are central determination methods and systems in which pools and sub-pools of outcomes can be distributed among various units of the central determination system. The methods and systems are applicable to Class II and, in some implementations, Class III gaming configurations. The methods and systems disclosed herein can be implemented in a gaming machine network, wherein one of the gaming machines distributes game outcomes to other gaming machines in the network. The gaming machines can be oriented in a peer-to-peer configuration, a central storage medium configuration, a stand alone configuration, an autonomous gaming machine configuration, and other network configurations. Methods are disclosed for managing the distribution of outcomes among the gaming machines in the various networks.

14 Claims, 14 Drawing Sheets

GAMING METHODS AND SYSTEMS

BACKGROUND OF THE INVENTION

The present disclosure relates to gaming machines, networks, systems and methods for providing games of chance.

Gaming in the United States is divided into Class I, Class II and Class III games. Class I gaming includes social games played for minimal prizes, or traditional ceremonial games. Class II gaming includes bingo games, pull tab games if played in the same location as bingo games, lotto, punch boards, tip jars, instant bingo, and other games similar to bingo. Class III gaming includes any game that is not a Class I or Class II game, such as a game of chance typically offered in non-Indian, state-regulated casinos. Many games of chance that are played on gaming terminals fall into the Class II and Class III categories of games.

Various games, particularly the Class II and Class III categories of games, can be implemented as server-based games in a server-client system. Server-based games are generally those in which the games and capabilities of a gaming terminal depend on a central server. The terminal may download game applications from the central server or may rely on the central server to run the games. In a games-on-demand system, a player can operate a gaming terminal to request a particular game for playing. In a download configuration, the requested game is downloaded from the central server to the gaming terminal, and then executed on the gaming terminal. In a server-based configuration, on the other hand, the requested game is executed on the server, and the player interacts with the server to play the game. For example, U.S. Pat. No. 5,779,549, "Database Driven Online Distributed Tournament System" and U.S. Pat. No. 6,409,602, "Slim Terminal Gaming System," both of which are hereby incorporated by reference, describe server-based systems where no processing occurs on the gaming terminal. The game is executed on the central server, and the gaming terminal operates as an IO device for a player to interact with the central server. The game play, meter tracking, and other game functions are all carried out on the central server.

Central determination gaming refers to any gaming method or system in which a central computer determines game outcomes, regardless of player input on a gaming terminal. Most conventional central determination systems are used for Class II gaming. For example, an electronic bingo game may be implemented as a central determination game, in which a number of gaming terminals are in communication with the central computer. The central computer draws the bingo numbers from a pool of outcomes to determine who wins.

Morris et al., U.S. Pat. No. 5,324,035, entitled "Video Gaming System With Fixed Pool of Winning Plays and Global Pool Access," which is hereby incorporated by reference, describes a central determination gaming system in which a central processor or computer generates game plays. A plurality of master processing units are coupled to the central computer. Each master processing unit is also coupled to one or more gaming terminals. In this way, a master processing unit serves as an interface between the central processor and the gaming terminals to manages game play requests from the gaming terminals, and to distribute game plays from the central processor to the gaming terminals.

In U.S. Pat. No. 5,324,035, ('035 patent), one purpose of the master processing units is to handle network traffic. This is because conventional gaming systems of that era having a single central processor, such as the system described in the '035 patent, do not have the bandwidth and speed required to handle the volume of data transferred in a casino with a multitude of electronic gaming terminals. Thus, conventional gaming systems such as the system described in the '035 patent require two levels of processors or computers, namely the central game processor and master processing units. Both the central processor and master processing units are required to perform the computations necessary to generate game plays, and distribute those game plays to gaming terminals. In addition, the system described in the '035 patent requires the hierarchy of gaming terminals communicating directly with master processing units, and the master processing units communicating directly with the central processor. The central determination system of the '035 patent does not provide any alternative configurations that might be better suited to certain casino and hotel environments, for instance, where the gaming terminals are configured to communicate directly with one another. Moreover, the system of the '035 patent does not offer effective techniques for monitoring game play usage at the various gaming terminals in the system.

What are needed are flexible methods and systems to optimize the generation, distribution, and management of game outcomes among gaming terminals in various gaming system configurations and implementations.

SUMMARY OF THE INVENTION

Disclosed are methods and apparatus, including computer program products, implementing and using techniques for central determination methods and systems in which pools and sub-pools of outcomes can be distributed among various units of the system.

According to one aspect of the present invention, a gaming system includes a plurality of gaming machines coupled to one another over a data network. The gaming machines include a distributing gaming machine and a plurality of receiving gaming machines. A finite pool of outcomes is stored on the storage medium accessible by the distributing gaming machine. The distributing gaming machine is coupled to distribute game outcomes from the finite pool over the data network. The receiving gaming machines are each coupled to receive one or more of the distributed outcomes over the data network. The distributing gaming machine and receiving gaming machines are operable for game play to consume the outcomes. According to one aspect, the gaming system includes a recording unit coupled to maintain a record of the outcomes distributed to the various gaming machines and the outcomes remaining in the finite pool.

According to another aspect of the present invention, a gaming system is implemented in a peer-to-peer configuration. The gaming system includes a plurality of gaming machines coupled to one another over a data network. A finite pool of outcomes is distributed among the gaming machines and stored on one or more storage mediums accessible by the gaming machines. One or more of the gaming machines are coupled to receive distributed outcomes from other gaming machines in the peer-to-peer gaming network and to send distributed outcomes to the other gaming machines over the network. Each of the gaming machines is operable for game play to consume the distributed outcomes, for instance, in a game of chance. In one aspect, the gaming system includes a recording unit, coupled to maintain a record of the outcomes distributed to the gaming machines and the outcomes remaining in the finite pool.

According to another aspect of the present invention, a gaming system includes a processor readable storage medium coupled to a data network. The storage medium stores a finite pool of outcomes. A plurality of gaming machines are also coupled to the data network. Each gaming machine is coupled to access and retrieve one or more of the outcomes from the finite pool over the data network. The gaming machines are operable for game play to consuming outcomes, for instance, in a game of chance. In one aspect, the gaming system further includes a recording unit coupled to maintain a record of the outcomes retrieved by the gaming machines and the outcomes remaining in the finite pool. In one aspect, the system further includes a distributing computer coupled to the data network to populate the storage medium with the finite pool of outcomes.

According to another aspect of the present invention, a gaming system includes a plurality of gaming machines in a stand alone configuration. The gaming machines are coupled to a data network. One of the gaming machines is a distributing gaming machine having an outcome generator unit coupled to generate outcomes, in some implementations, pools of outcomes, stored on a storage medium accessible by the distributing gaming machine. The distributing gaming machine is coupled to distribute the pools of game outcomes over the data network. Other gaming machines in the network are coupled to receive one or more of the distributed pools from the distributing gaming machine over the data network. The distributing and receiving gaming machines are all operable for game play to consume the outcomes from the distributed pools. In one aspect, the distributing gaming machine further includes a pay back monitoring unit coupled to monitor payback amounts for the distributed pools of outcomes.

According to another aspect of the present invention, a gaming system is arranged to have autonomous gaming machines. The gaming system includes a recording unit coupled to a data network. The recording unit is coupled to record outcomes consumed from a finite pool of outcomes stored on a processor readable storage medium. The gaming system further includes a plurality of gaming machines coupled to the data network. At least one of the gaming machines has an outcome generator unit coupled to generate one or more game outcomes, generally, in response to a game play request received from a player. The at least one gaming machine is coupled to notify the recording unit of the generated game outcomes. The recording unit is coupled to record the generated game outcomes as the outcomes consumed from the finite pool. In one aspect, the recording unit is also coupled to maintain a record of the game outcomes remaining in the finite pool stored at the storage medium. In one aspect, the gaming system further includes a notice unit coupled to send a notice message to the gaming machines upon the consuming of a winning or loosing outcome defined by one or more of the generated outcomes.

According to another aspect of the present invention, a method is provided for managing distribution of the outcomes in a gaming system. The gaming system includes a plurality of gaming machines coupled to one another over a data network. A finite pool of outcomes is distributed among the gaming machines. Each outcome has a status of consumed or unconsumed. One of the gaming machines is coupled to receive one or more distributed outcomes from others of the gaming machines over the data network. Another one of the gaming machines is coupled to send one or more of the distributed outcomes to the one gaming machine over the data network. The gaming machines are each operable for game play to consume the distributed outcomes. A threshold is defined for one or more gaming machines. In one implementation, each threshold represents a minimum or maximum number of unconsumed outcomes for the respected gaming machine. In one implementation, it is determined when a number of unconsumed outcomes distributed to one of the gaming machines is less than the threshold defined for that gaming machine. When the number of unconsumed outcomes is less than the threshold, an outcome request message is sent. Responsive to the outcome request message, a further one of distributed outcomes is retrieved and sent to the one gaming machine.

All of the foregoing methods, along with other methods of aspects of the present invention, may be implemented in software, firmware, hardware and combinations thereof. For example, methods of aspects of the present invention may be implemented by computer programs embodied in machine-readable media and other products. Generally, aspects of the invention may be implemented in networked gaming terminals, game servers and other such devices. These and other features and benefits of aspects of the invention will be described in more detail below with reference to the associated drawings.

DETAILED DESCRIPTION OF THE EMBODIMENTS

Figure 1:
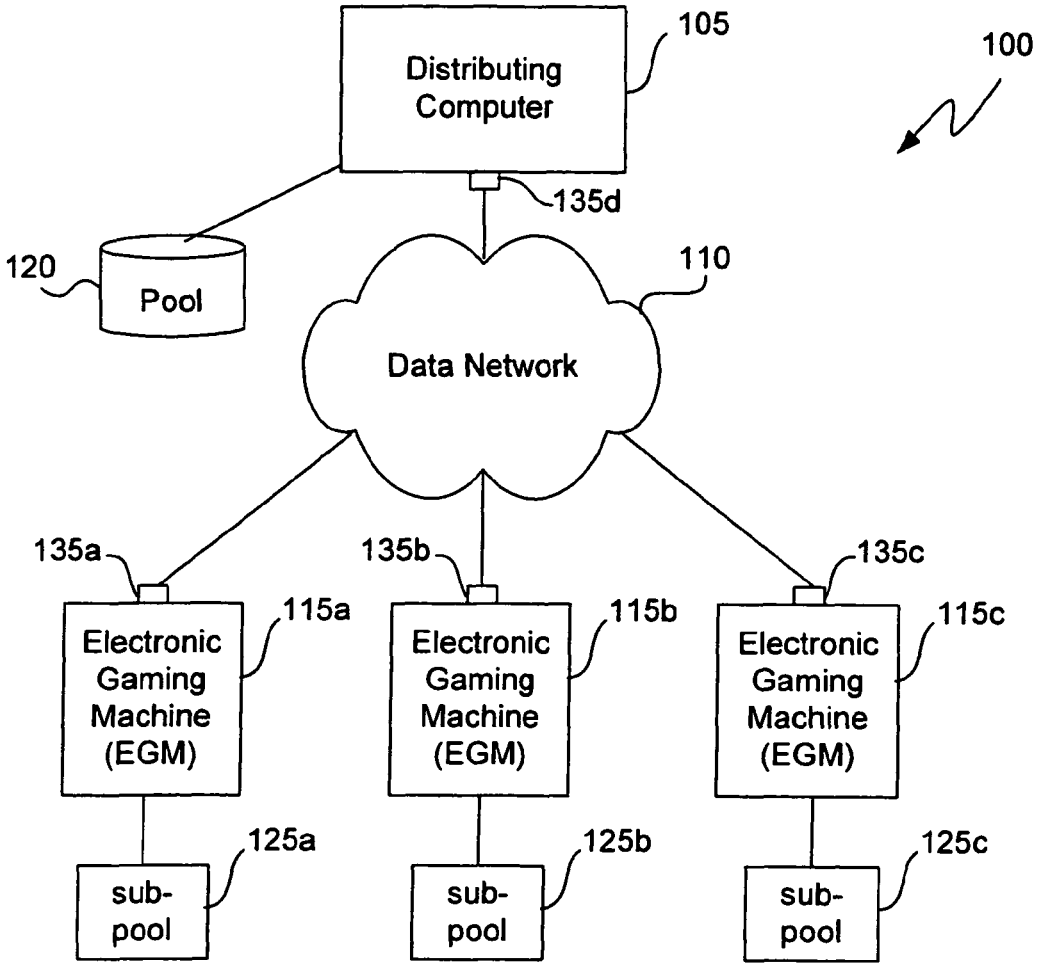
FIG. 1 shows a block diagram of a central determination gaming system 100, constructed according to one embodiment of the present invention.

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

Embodiments of the present invention provide methods and systems in which pools and sub-pools of outcomes can be distributed among various units of a gaming system. The methods and systems described herein are applicable to gaming systems including Class II and, in some implementations, Class III gaming configurations. In one embodiment, the methods and systems described herein are implemented in a gaming system described in commonly assigned and co-pending patent application Nguyen et al., U.S. patent application Ser. No. 11/078,966, entitled "Secured Virtual Network in a Gaming Environment," filed Mar. 10, 2005, which is hereby incorporated by reference. The units in the gaming systems described herein can include a distributing computer or gaming machine, a central computer and/or database, and one or more gaming machines operable by players to play games. The distributing computer is one implementation of a game server, described below. For use in the disclosed embodiments, one example of a suitable gaming machine and associated methods is described in commonly assigned and co-pending patent application Nguyen et al., U.S. patent application Ser. No. 10/995,636, entitled "Class II/Class III Hybrid Gaming Machine, System and Methods," filed Nov. 22, 2004, which is hereby incorporated by reference.

The computers, machines and units described herein can be situated in various locations, depending on the desired implementation. For example, in one system embodiment, a distributing computer is located in an administrative facility, one gaming machine is located in a casino, and another gaming machine is located in a hotel room. In another embodiment, the distributing computer and all of the gaming machines are located in a single casino. The apparatus within the various units is described below. As used herein, "computer" generally refers to a data processing apparatus such as a server or computer configured to perform certain operations, including those described below. The computer generally includes hardware and software executable to perform the various operations.

FIG. 1 shows a central determination gaming system 100 constructed according to one embodiment of the present invention. In FIG. 1, a distributing computer 105 is in communication with a suitable data network 110. Examples of data network 110 include a local area network (LAN) or wide area network (WAN) such as the Internet, or any combination thereof. Those skilled in the art will appreciate that any data network 110 which enables the communications described herein is suitable for use in system 100, including the networks described below with respect to FIGS. 12, 13 and 14.

In FIG. 1, the gaming system 100 further includes a plurality of electronic gaming machines 115*a*, 115*b* and 115*c*. The hardware and software of gaming machines 115*a-c* is described below with respect to FIGS. 12-14 in accordance with embodiments of the present invention. The gaming machines 115*a-c* are in communication with the distributing computer 105 over the data network 110. The gaming machines 115*a-c* and distributing computer 105 each have a suitable communications interface 135*a*, 135*b*, 135*c* and 135*d*, coupled to data network 110 to facilitate communications over the network 110. In one example, communications interfaces 135*a-d* are Ethernet ports. Those skilled in the art will appreciate that communications interfaces 135*a-d* can be implemented as other suitable high-speed communications interfaces. In the other embodiments described herein, the gaming machines and computers have such communications interfaces similarly coupled, although not shown in all of the Figures.

In FIG. 1, the gaming system 100 provides for the generation and distribution of outcomes and sets of outcomes among the gaming machines 115*a-c*. The outcomes generated and distributed in accordance with embodiments of the present invention are game outcomes for any of a variety of games, that is, game applications which can be played using embodiments of the present invention. For example, in one game, each of the outcomes includes an indication of a winning or losing game outcome. In addition, or in another embodiment, each outcome includes or designates an award amount for the particular game being played.

In FIG. 1, each of the gaming machines 115*a-c* communicate directly with the distributing computer 105 over the data network 110. Preferably, there is no intermediary or central computer through which the gaming machines communicate to reach the distributing computer 105, and vice versa.

In FIG. 1, in one embodiment, the outcomes for the game to be played are initially stored in a finite pool of outcomes in a storage medium 120, such as a suitable memory device or database. Distributing computer 105 is coupled to distribute part or all of the outcomes from the finite pool stored in storage medium 120. The electronic gaming machines 115*a-c* are coupled to receive these distributed outcomes. In one embodiment, subsets of the finite pool of outcomes, referred to herein as sub-pools of outcomes, are distributed among the respective gaming machines. As shown in FIG. 1, in this example, sub-pool 125*a* is received and stored by gaming machine 115*a* in a suitable storage medium, sub-pool 125*b* is received by gaming machine 115*b*, and so on. The sub-pools 125*a*, 125*b* and 125*c*, as shown in FIG. 1, form subsets of the entire or master set of outcomes in finite pool 120.

Figure 2:
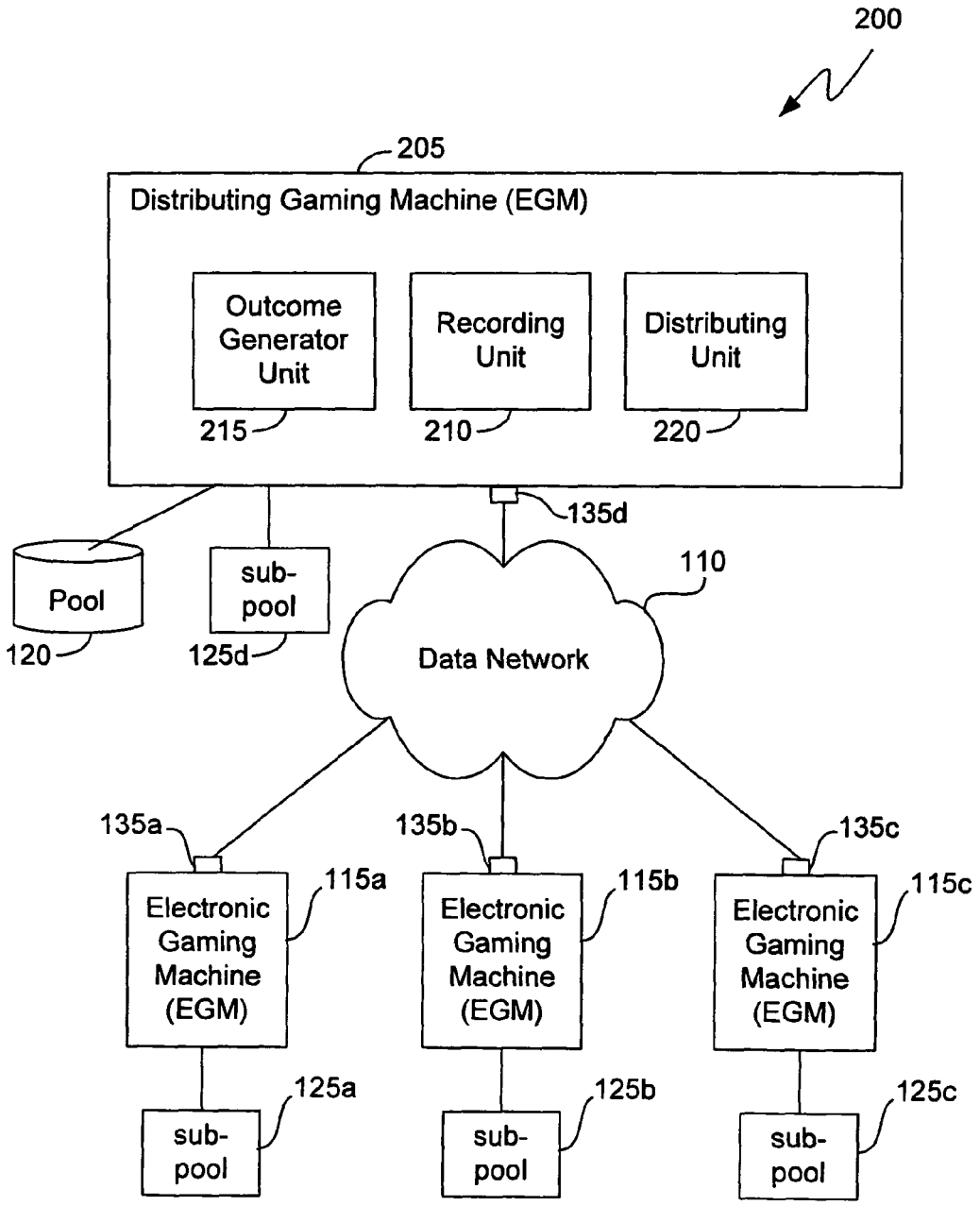
FIG. 2 shows a block diagram of a central determination gaming system 200, constructed according to another embodiment of the present invention.

FIG. 2 shows a gaming system 200 constructed to another embodiment of the present invention. The gaming system 200 of FIG. 2 is similar to the system 100 of FIG. 1 in many respects. However, in system 200, one of the plurality of gaming machines coupled to data network 110, namely gaming machine 205, is substituted for distributing computer 105. Gaming machine 205, also referred to herein as "distributing gaming machine" or "distributing machine," is coupled to control the distribution of outcomes from the finite pool of outcomes in storage medium 120 to the gaming machines 115*a-c*. Those skilled in the art will appreciate, in this embodiment, that the gaming machine 205 includes the necessary software and hardware to perform methods to generate and manage the finite pool of outcomes in medium 120 and communicate directly with the gaming machines 115*a-c* to distribute one or more of the outcomes from the finite pool to those gaming machines 115*a-c*, similar to distributing computer 105 in FIG. 1.

In FIG. 2, the gaming system 200 further comprises a recording unit 210 coupled to maintain a record of the outcomes distributed from the finite pool to the gaming machines. By the same token, recording unit 210 regularly updates the record to track the outcomes remaining in the finite pool. The operation of recording unit 210 is described in greater detail below. In one embodiment, recording unit 210 is situated in distributing gaming machine 205, as shown in FIG. 2. In another embodiment, recording unit 210 is coupled at another location to maintain the record, for example, in one of the gaming machines 135*a-c*, or as a stand-alone device coupled to data network 110.

In FIG. 2, gaming system 200 further includes an outcome generator unit 215 operable to generate the outcomes of the finite pool stored in storage medium 120. In one embodiment, outcome generator unit 215 includes a random number generator which generates random numbers using deterministic or non-deterministic methods, as desired for the particular implementation. These random numbers are used to define outcomes using conventional techniques known to those skilled in the art. In one embodiment, a seed is provided to distributing gaming machine 205 from any of a variety of sources and input to the random number generator (RNG) to generate random numbers. In one embodiment, outcome generator unit 215 is situated in distributing gaming machine 205, as shown in FIG. 2. In another embodiment, outcome generator unit 215 is situated at a computer or server with which the gaming machine 205 communicates over data network 110. Those skilled in the art will appreciate that the number and cumulative award amounts for outcomes generated by outcome generator unit 215 should be in compliance with applicable gaming regulations in the jurisdiction(s) in which the methods and systems described herein are practiced.

In the systems 100 and 200, generally the gaming machines 115*a-c* serve as receiving gaming machines, in that these gaming machines are coupled to receive one or more of the outcomes from the finite pool and distributed by the distributing computer 105 or distributing gaming machine 205. In one embodiment, distributing gaming machine 205 also serves as a receiving gaming machine. In this embodiment, gaming machine 205 receives its own sub-pool of outcomes 125*d* from the finite pool of outcomes, the same as receiving gaming machines 115*a-c*. Thus, games can be played on any of the machines 115*a-c*, 205 coupled to the network 110. In other embodiments, any of the other gaming machines 115*a-c* can be configured as the distributing gaming machine 205, depending on the desired implementation.

Figure 3:
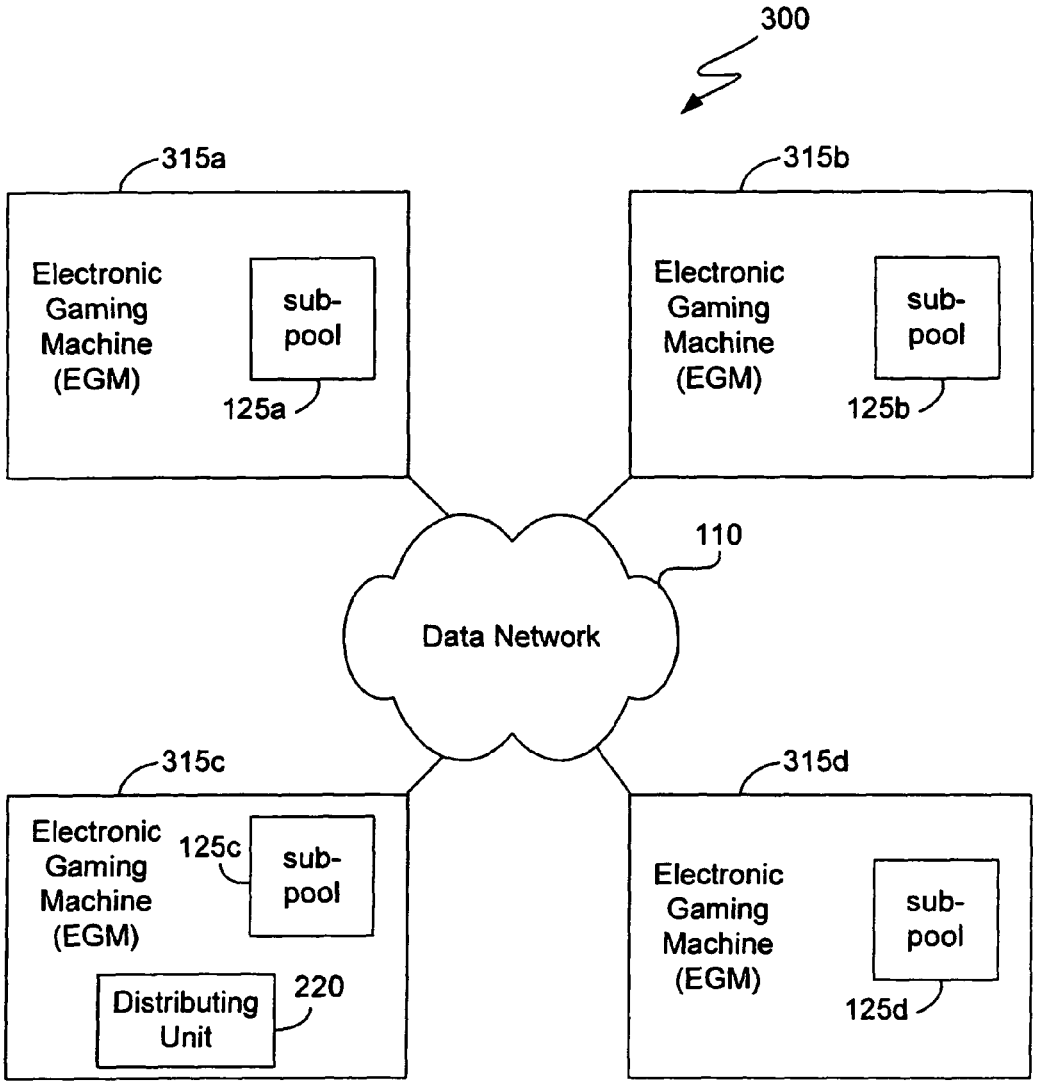
FIG. 3 shows a block diagram of a peer-to-peer gaming system 300, constructed according to another embodiment of the present invention.

FIG. 3 shows a gaming system 300 constructed according to another embodiment of the present invention. The system 300 includes a plurality of gaming machines 315*a-d* coupled to a suitable data network 110 as shown. The gaming machines 315*a-d* are in communication with one another over data network 110. In some implementations, this arrangement of system 300 is referred to as a "peer-to-peer" configuration. That is, each gaming machine 315*a-d* is configured to have the functionality of both a receiving gaming machine and a distributing gaming machine, as described above with respect to FIG. 2.

In FIG. 3, the finite pool of outcomes described above is distributed in sub-pools among the gaming machines 315*a-d*. Generally, these sub-pools 125*a-d* distributed among the respective gaming machines 315*a-d* are stored in processor readable storage mediums or other suitable memory devices within or accessible by the gaming machines 315*a-d*. Because each gaming machine in the system 300 is operable as both a distributing gaming machine and a receiving gaming machine, the gaming machines can exchange outcomes or sub-pools of outcomes with one another. Such a peer-to-peer configuration is beneficial for implementations in which certain ones of the gaming machines are played more frequently than others. More outcomes will be consumed on the heavily played machines. As the outcomes and sub-pools on the heavily played machines are consumed, these machines can request and obtain outcomes from other machines in the system as needed. Accordingly, in one implementation, the system is optimized so the gaming machines obtain outcomes to achieve fast response times and maximize user enjoyment of games played on those machines.

As used herein, the term "consumed" is used to refer to the use and output of game outcomes during game play on any of the various gaming machines described herein. The terms "not consumed" and "unconsumed" are used interchangeably herein to describe outcomes which have not yet been consumed for game play. For example, an electronic poker outcome is consumed when that outcome is provided to a player of a poker game application during or otherwise as a result of game play.

In FIG. 3, the gaming system 300 provides for the distribution of the sub-pools 125*a-d* as shown according to a variety of methods. In one embodiment, similar to system 200 of FIG. 2, one of the gaming machines 315*a-d* initially serves as the distributing gaming machine 205, and distributes sub-pools from a finite pool of outcomes among the various machines. In one example, as shown, after such distribution, each machine 315*a-d* has a unique subset of one or more of the finite pool of outcomes. Those skilled in the art will appreciate that, in one embodiment, each gaming machine 315*a-d* stores a single sub-pool of outcomes. In another embodiment, each gaming machine 315*a-d* can store more than one of these sub-pools. In yet another embodiment, rather than distribute sub-pools 315*a-d*, a single machine such as gaming machine 315*a* controls the finite pool of outcomes 120, similar to system 200 of FIG. 2, and sends outcomes from the finite pool to the other machines 315*b-d* in the network as needed.

Figure 4:
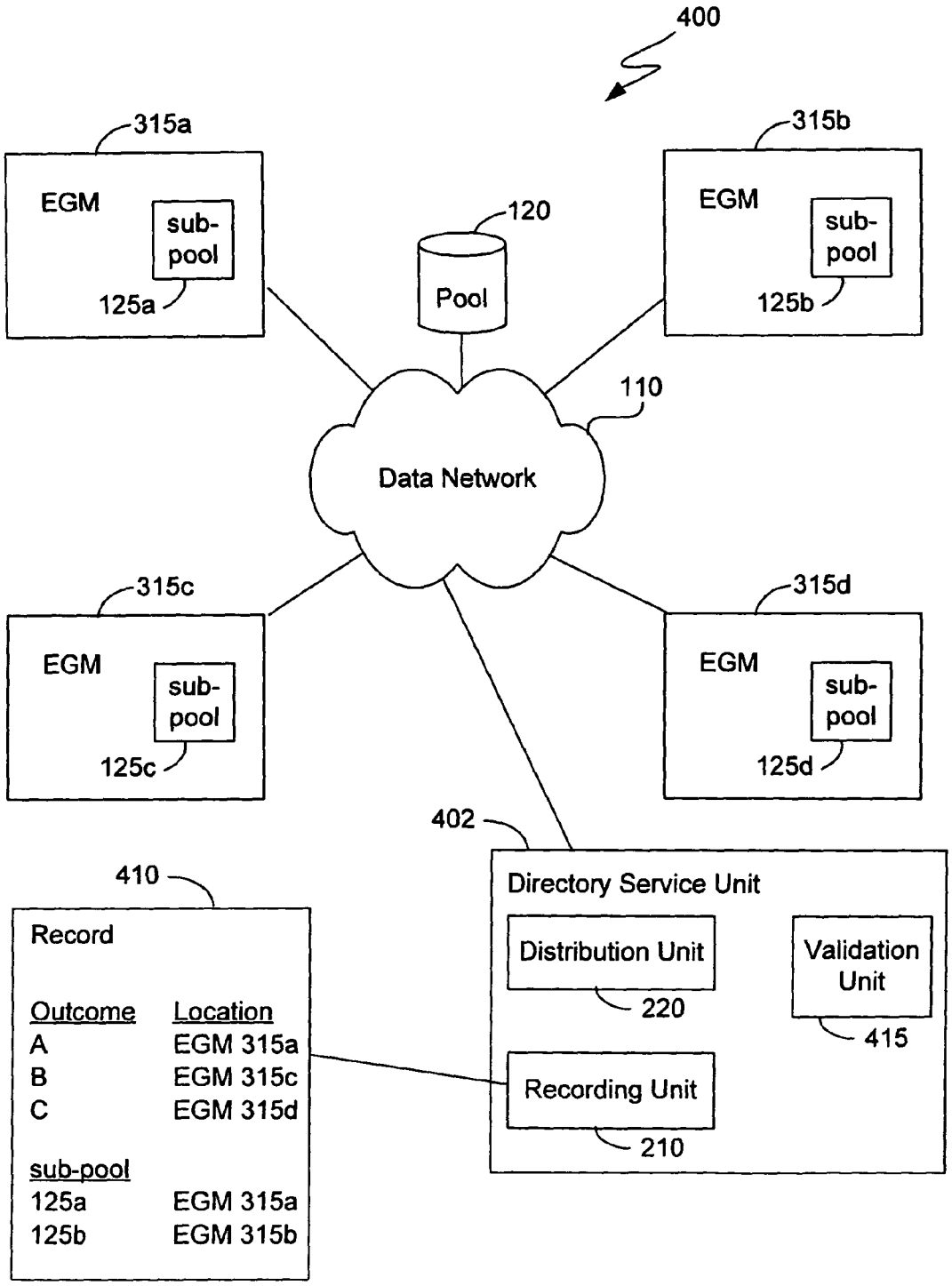
FIG. 4 shows a block diagram of a central determination gaming system 400, constructed according to another embodiment of the present invention.

FIG. 4 shows a gaming system 400 constructed according to another embodiment of the present invention. The system 400 of FIG. 4 is similar in most respects to system 300 of FIG. 3. That is, system 400 incorporates all of the apparatus and methods of system 300. In addition, system 400 includes directory service unit 402 coupled to data network 110, described below. In this embodiment, each of the sub-pools 125*a*-125*d* distributed among the respective gaming machines 315*a-d*, as described above, are all unique subsets of a finite pool of outcomes initially defined for the system 400.

In FIG. 4, in one embodiment, the sub-pools 125*a*-125*d* are distributed among the gaming machines independent of any game play request message received on one or more of the gaming machines 315*a-d*. For example, in one embodiment, the sub-pools are distributed before game play begins on any of the machines 315*a-d*. In one embodiment, after the finite pool of outcomes in storage medium 120 is entirely consumed by the gaming machines 315*a-d* in the network 400, an outcome generator unit 215, described herein, is coupled to generate a further set of outcomes for storage in medium 120 and distribution among the gaming machines 315*a-d*.

In FIGS. 3 and 4, each of the gaming machines 315*a-d* coupled to data network 110 can access its own sub-pool or one or more of the sub-pools associated with the other gaming machines in the data network 110. That is, because the gaming machines 315*a-d* are in a peer-to-peer configuration, the gaming machines 315*a-d* can send and receive outcomes and the sub-pools of outcomes to one another as desired.

In FIG. 4, in one embodiment, the directory service unit 402 provides a directory service by including a recording unit 210 coupled to maintain a record of the outcomes consumed at the gaming machines from the distributed sub-pools 125*a-d*. In one embodiment, this record also indicates the outcomes remaining in the finite pool that have not yet been consumed. In addition, this recording unit 210 maintains a record 410 of the locations of outcomes and sub-pools of outcomes distributed among the gaming machines. Thus, as outcomes and sub-pools of outcomes are exchanged between the gaming machines 315*a-d*, update messages are sent from those gaming machines 315*a-d* to the directory service unit 402 so that the recording unit 210 updates the record of outcomes 410 to show the locations of the various outcomes and sub-pools of outcomes. Preferably, the record 410 is also updated to indicate the status of those outcomes, e.g., "consumed," "not consumed". In one example, in the peer-to-peer configuration of FIG. 4, gaming machine 315*b* requests an outcome from sub-pool 125*a* of gaming machine 315*a*. Gaming machine 315*a* sends the requested outcome to distributing computer 105, at which time the recording unit 210 updates the record to show that the particular outcome is being delivered and consumed by gaming machine 315*b*. In another embodiment, the recording unit 210 waits until it receives a confirmation message from gaming machine 315*b* indicating that the particular outcome was consumed, before updating the record 410.

Those skilled in the art should appreciate that the directory service unit 402 can be implemented in other apparatus of a gaming system, such as one of the gaming machines 315*a-d* of FIGS. 3 and 4.

One benefit of the directory service unit described herein, including recording unit 210, is the monitoring of outcomes and pools or sub-pools distributed among gaming machines in the gaming system. In this way, for example, an even distribution of outcomes among the gaming machines can be maintained when desired. In one implementation, when outcomes are consumed at a lower rate on certain machines, outcomes can be recalled from those machines, for instance, by distributing gaming machine 205 in FIG. 2, and sent to other machines in the system for consumption. Or, in another implementation, the distributing gaming machine 205 cancels or notifies the gaming machines to cancel those unused outcomes. In yet another implementation, each gaming machine in the system 400 has its own recording unit to maintain a record or otherwise monitor outcomes consumed on that machine. The gaming machines 315*a-d* are coupled to communicate this information with one another for load balancing of outcomes on the various machines.

In yet another embodiment, described with reference to FIGS. 3 and 4, outcomes, sub-pools and pools of outcomes can be stored redundantly among a plurality of the gaming machines 315*a-d* in the gaming system. In this way, when a set of outcomes on one of the machines 315*a* is closed or otherwise made unavailable, the same outcomes may be retrieved or consumed on another of the machines 315*b-d*. Also, preferably each of the sub-pools 125*a-d* includes a minimum percentage payback required by the jurisdiction in which the gaming system is implemented, e.g., 75 percent payback. For example, in one embodiment, the redundancy in system 400 is such that the sub-pools 125*a-d* are copies of one another. In this embodiment, each sub-pool is stored in a storage medium within or coupled to the respective gaming machines 315*a-d*. For auditing and validation purposes, the recording unit 210 maintains a record of which outcomes are consumed on which gaming machines in the data network.

In another embodiment, the record 410 maintained by directory service unit 402 is replicated across a plurality of the gaming machines in the network. For example, in FIG. 4, copies of the record 410 maintained by recording unit 210 can also be provided on gaming machines 315*a* and 315*c*. In this way, gaming machines can access this information at various locations, even when the directory service unit 402 or one of the gaming machines 315*a* and 315*c* is malfunctioning or otherwise unavailable.

In another embodiment, described with respect to FIG. 4, the directory service unit 402 includes a validation unit 415 which operates in conjunction with the recording unit 210 to verify that the outcomes consumed on the various gaming machines, as recorded by recording unit 210, meet minimum required percentage paybacks for the jurisdiction in which the gaming machines are played. For example, when the paybacks for the consumed outcomes exceed a predetermined maximum, then the directory service unit 402 can send a payback reduction message to outcome generator unit 215, of FIG. 2, to generate appropriate outcomes for future sub-pools and pools of outcomes. Thus, the directory service unit 402 not only enables auditing, but also ensures compliance with jurisdictional payback requirements.

Figure 5:
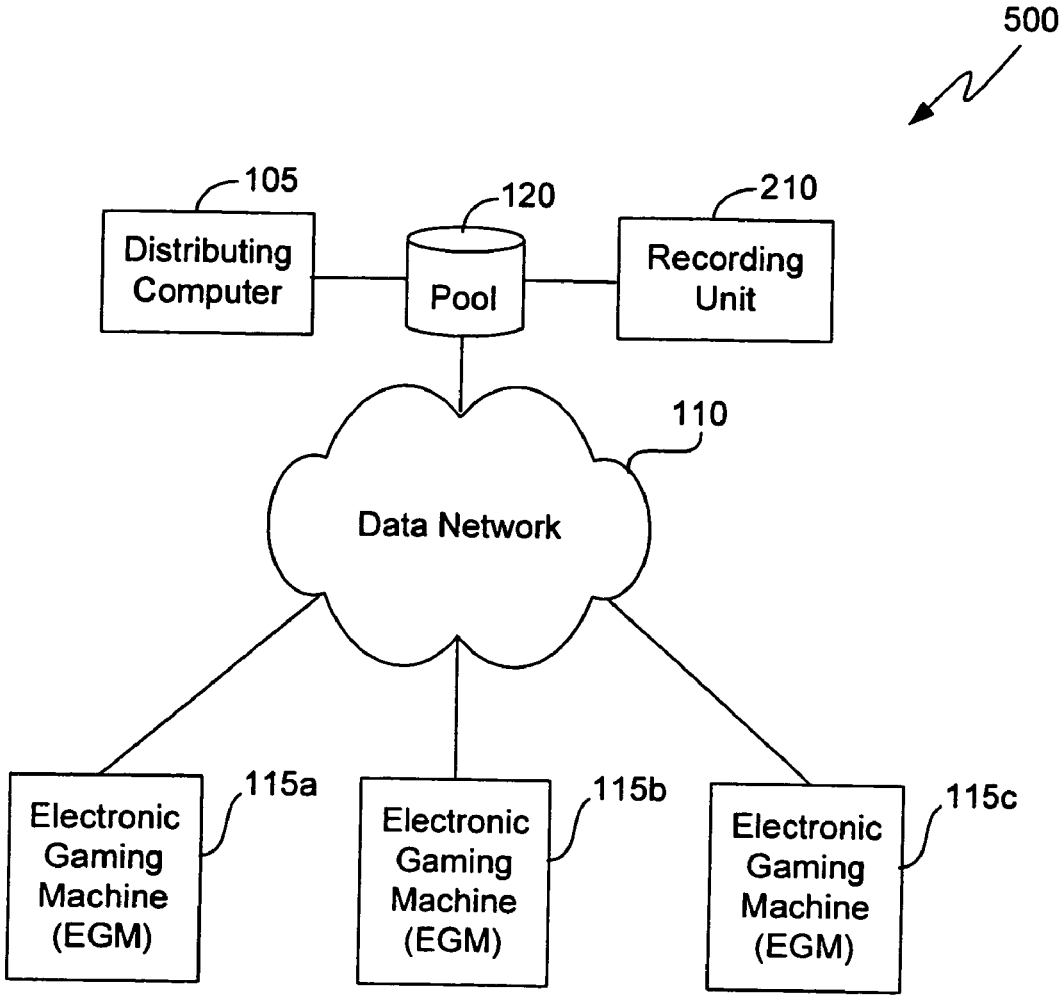
FIG. 5 shows a block diagram of a central determination gaming system 500, constructed according to another embodiment of the present invention.

FIG. 5 shows a gaming system 500 constructed according to another embodiment of the present invention. Unlike system 100 of FIG. 1, in FIG. 5, the processor readable storage medium 120 is coupled directly to data network 110. In this embodiment, distributing computer 105 is coupled directly to storage medium 120 over a suitable communications link established directly with storage medium 120. Distributing computer 105 interacts directly with storage medium 120, but does not interact directly with gaming machines 115*a-c*. Storage medium 120 stores the finite pool of outcomes, similar to the embodiments described above. In this embodiment, the distributing computer 105 is coupled to populate the storage medium 120 with the pool of outcomes.

In FIG. 5, in one embodiment, the finite pool of outcomes in storage medium 120 is then accessed on a transaction-by-transaction basis by the various gaming machines 115*a-c*. That is, each gaming machine fetches outcome(s) on an as-needed basis, according to the game being played on that machine. In this way, each gaming machine 115*a-c* is coupled to retrieve one or more of the outcomes from the finite pool as needed for game play. In an alternative embodiment, gaming machines 115*a-c* can fetch a group or sub-pool of the outcomes, for instance, before game play begins.

In FIG. 5, in one embodiment, recording unit 210 is coupled to storage medium 120 to maintain a record of the outcomes retrieved by the various gaming machines 115*a-c*, and the outcomes remaining in the finite pool of outcomes, as described herein. The recording unit 210 can be situated at various locations. In one implementation, the recording unit 210 is situated in the storage medium 120, as described below with respect to FIG. 8, and is updated on a transactional basis as outcomes are retrieved by the various gaming machines 115*a-c*. In another implementation, the recording unit 210 is situated in distributing computer 105 and similarly updated.

In FIG. 5, in one implementation, a gaming machine such as machine 115*a* is coupled to retrieve one or more of the outcomes from the finite pool in storage medium 120 responsive to a game play request message received on the gaming machine through a suitable interface, as described below. In another implementation, the gaming machine is coupled to retrieve outcomes from the finite pool in storage medium 120 without regard to game play request messages received on that gaming machine. For instance, a sub-pool of outcomes from the finite pool can be retrieved by gaming machine 115*a* before game play begins.

Figure 6:
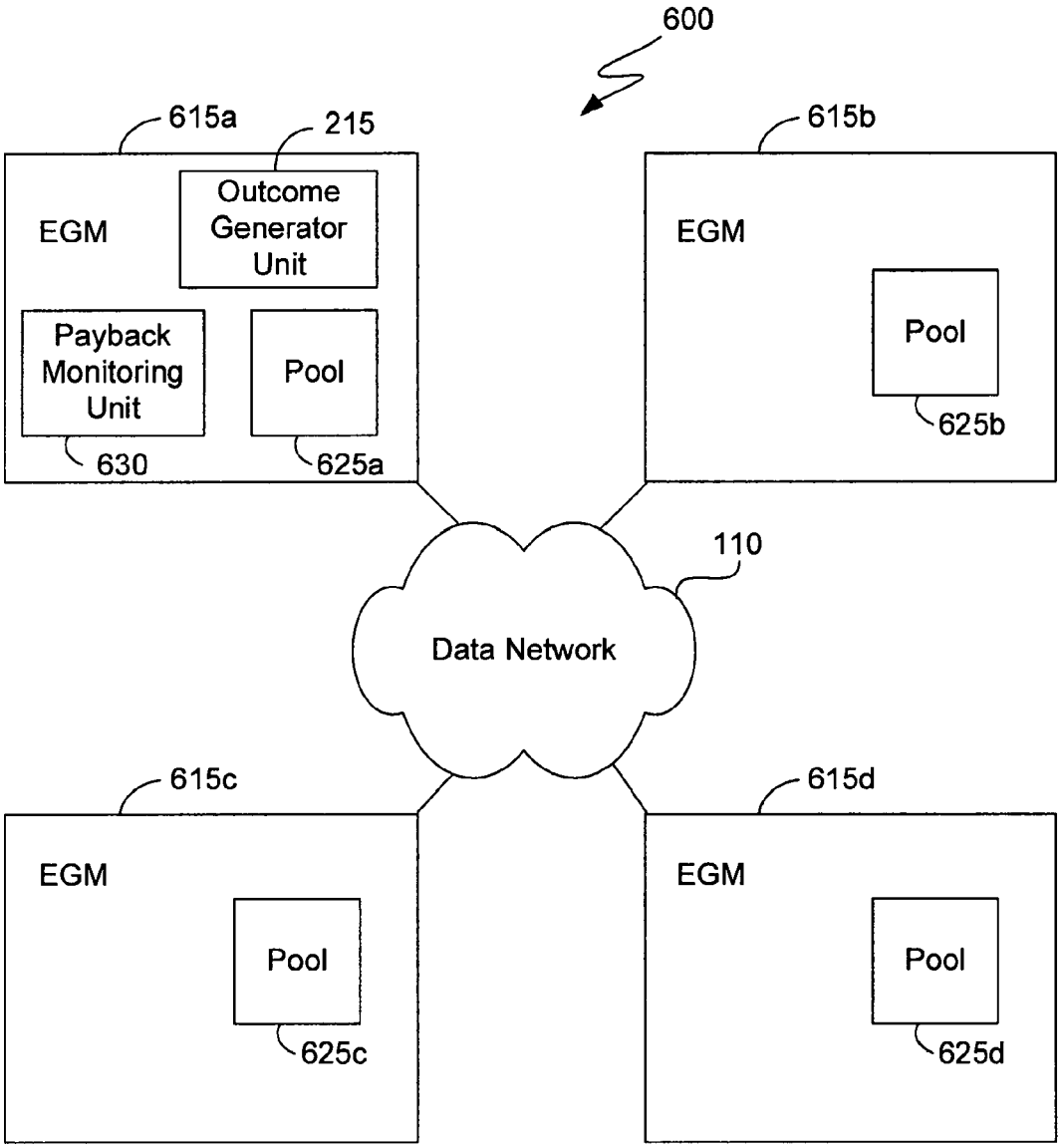
FIG. 6 shows a block diagram of a standalone gaming system 600, constructed according to one embodiment of the present invention.

In FIG. 6, an alternative embodiment is contemplated in which each gaming machine 615*a-d* operates as a stand-alone unit or apparatus. Each gaming machine 615*a-d* stores its own pool of outcomes. In one embodiment, the pools of outcomes 625*a-d* stored by the various gaming machines 615*a-d* are self-contained; that is, the pools do not form subsets of a larger finite pool. It is contemplated that, in one embodiment, one of the gaming machines includes an outcome generator unit 215, further described herein, to generate game outcomes for the particular game(s) played on the gaming machine 615*a* and for games played on other gaming machines 615*b-d*. Each gaming machine is coupled to receive these outcomes and populate storage mediums coupled to the respective gaming machines with those outcomes to define finite pools 625*a-d* for each gaming machine. Accordingly, each gaming machine's processor is coupled to retrieve one or more of the outcomes from the finite pool stored on a storage medium within or in communication with the processor in that gaming machine.

In FIG. 6, in one embodiment, when the finite pool of outcomes in a storage medium of a gaming machine is consumed, the outcome generator unit is coupled to populate the storage medium with a new finite pool of outcomes. In one embodiment, a gaming machine requests the new pool of outcomes by sending a request message to outcome generator unit 215 in gaming machine 615*a*.

In FIG. 6, in another embodiment, an expiration time is established and associated with each pool 625*a-d*. When the expiration time, e.g., 4 months, is reached, the associated outcomes are eliminated and no longer available. Those skilled in the art will appreciate that the implementation of such expiration times depends on the regulations of the jurisdiction(s) in which the gaming systems described herein are practiced.

In FIG. 6, in one embodiment, the pools 625*a-d* are purchased from the outcome generator unit 215 in the gaming machine 615*a*. In this implementation, a payback monitoring unit 630 monitors the outcomes purchased from outcome generator unit 215, and interacts with outcome generator unit 215 to ensure that the outcomes are balanced so that a certain payback percentage is maintained. For example, in one jurisdiction, a 75 percent payback rule is maintained by payback monitoring unit 630. A manufacturer controlling the outcome generator wishes to keep 10 percent of the proceeds. The casino includes 10,000 games/game outcomes on gaming machines in a gaming system, coupled as shown in FIG. 6. Each game is a dollar to play. In this example, the casino will buy the game outcomes from the manufacturer for 10 percent of the $10,000 worth of game outcomes, or $1,000. The casino will pay out 75 percent of the outcomes, or $7,500, and keep the remaining $1,500 as profit.

In another implementation of system 600 in FIG. 6, the gaming machine 615*a* functions as a kiosk, selling game outcomes or pools of outcomes generated by outcome generator unit 215 to other gaming machines.

Figure 7:
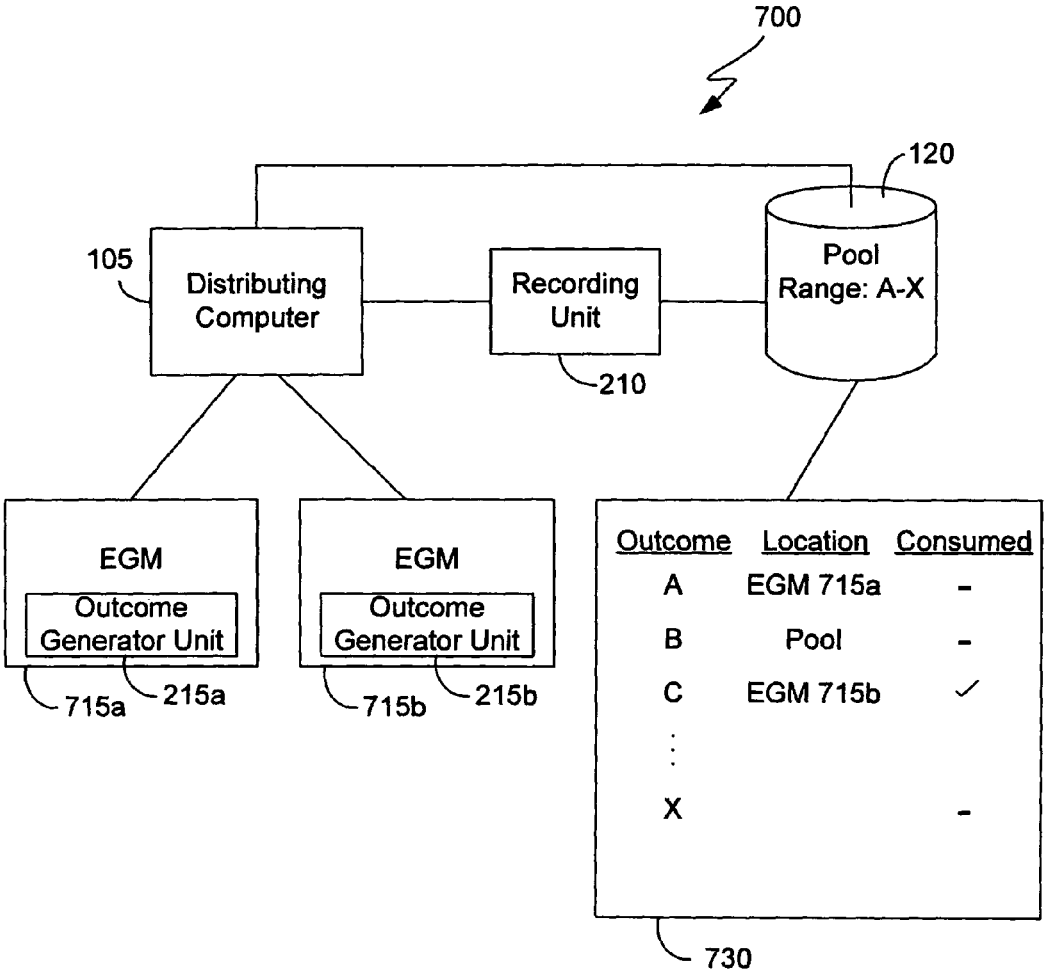
FIG. 7 shows a block diagram of an autonomous gaming system 700, constructed according to one embodiment of the present invention.

FIG. 7 shows a gaming system 700 with autonomous gaming machines 715*a* and 715*b*. The gaming machines 715*a* and 715*b* are in communication with a distributing computer 105 over a suitable data network such as network 110 of FIG. 1. In this embodiment, one or both of the gaming machines 715*a* and 715*b* communicate directly with distributing computer 105. In an alternative embodiment, the gaming machines 715*a* and 715*b* communicate with distributing computer 105 through an intermediary computer or other data processing apparatus.

In FIG. 7, a finite pool of outcomes is stored in storage medium 120 coupled to distributing computer 105. A range of permissible outcomes, e.g., outcomes A-X, is defined for the finite pool in storage medium 120. In one embodiment, a recording unit 210 is coupled to storage medium 120 to maintain a record 730 of the outcomes. Those skilled in the art will appreciate that the recording unit 210 can be situated in various locations of system 700 including within distributing computer 105, or otherwise in communication with the storage medium 120 as shown in FIG. 7.

In FIG. 7, each gaming machine 715*a* and 715*b* includes a respective outcome generator unit 215*a*, 215*b* as shown in FIG. 7. The outcome generator unit 215*a* is coupled to generate one or more game outcomes at the gaming machine 715*a*. The same is true for outcome generator 215*b* in gaming machine 715*b*. In one embodiment, the unit 215*a* generates outcomes in response to a game play request message received at machine 715*a* from a player of the game.

In FIG. 7, in one embodiment, when the outcome generator units 215*a* and 215*b* generate game outcomes for the respective game applications played on gaming machines 715*a* and 715*b*, each gaming machine is coupled to send update messages listing the generated game outcomes to the recording unit 210. In another embodiment of system 700 of FIG. 7, the generated game outcomes themselves are sent from the gaming machines 715*a* and 715*b* to recording unit 210 directly or through distributing computer 105, depending upon the desired implementation.

In FIG. 7, the recording unit 210 is coupled to record the received game outcomes in a record 730 maintained by recording unit 210 and stored in storage medium 120. In one embodiment, this record 730 includes a list showing the range of permissible outcomes for the gaming system 700.

When an update message is received, indicating that a game outcome within the range is generated at any of the gaming machines in the system 700, the recording unit 210 is coupled to update the record 730 to indicate that the particular game outcome has been consumed, as shown. In one example, as shown in FIG. 7, outcome C is indicated as having been consumed by one of the gaming machines, while outcomes A, B and D have not been consumed. In an alternative embodiment, a predetermined number of each outcome can be consumed, and the record maintains a tally of the number of each outcome consumed. In one implementation, the record 730 also includes an indication of the location for the outcome, that is, at which gaming machine the particular outcome was consumed.

Figure 8:
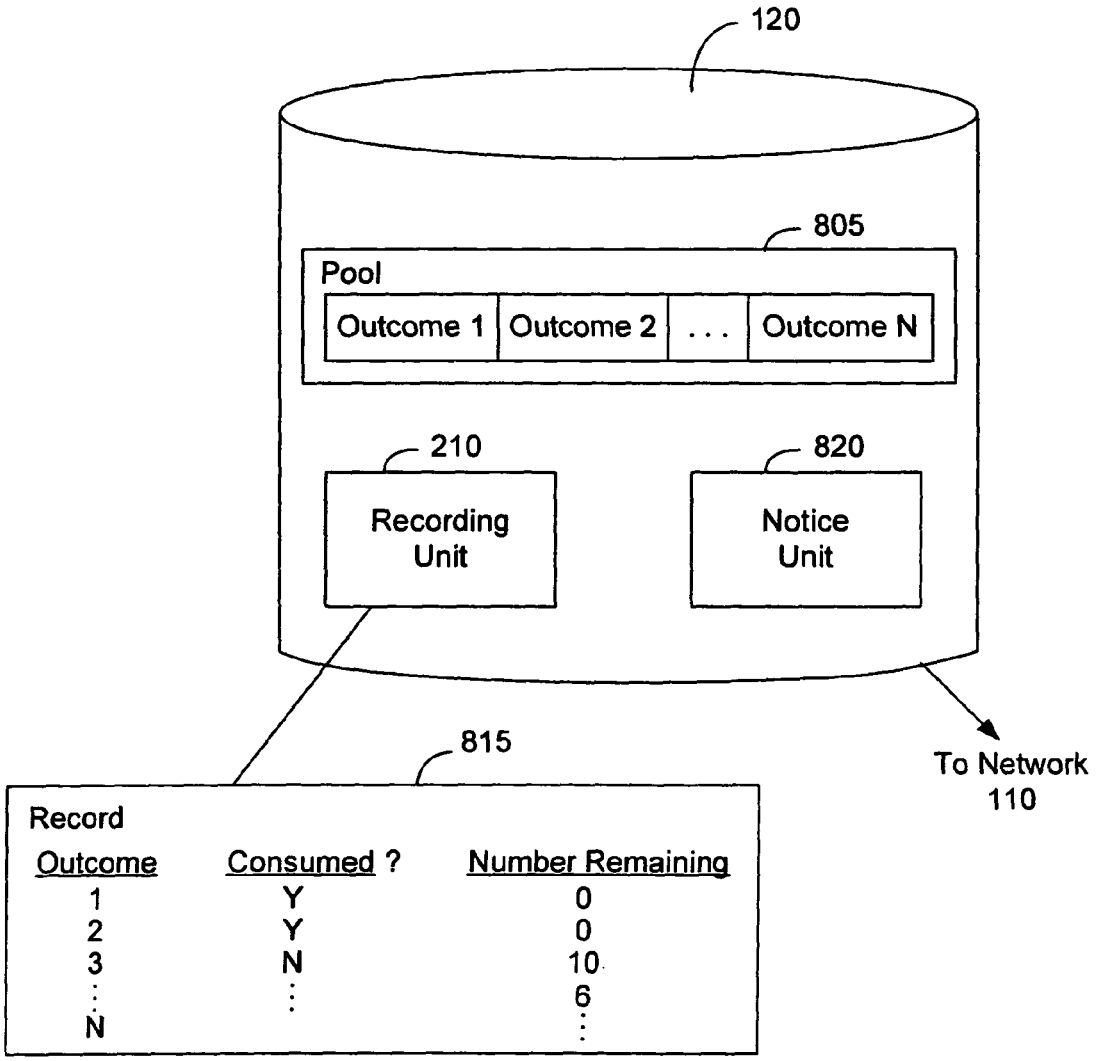
FIG. 8 shows a block diagram of a storage medium 120 and related apparatus, constructed according to one embodiment of the present invention.
Figure 9:
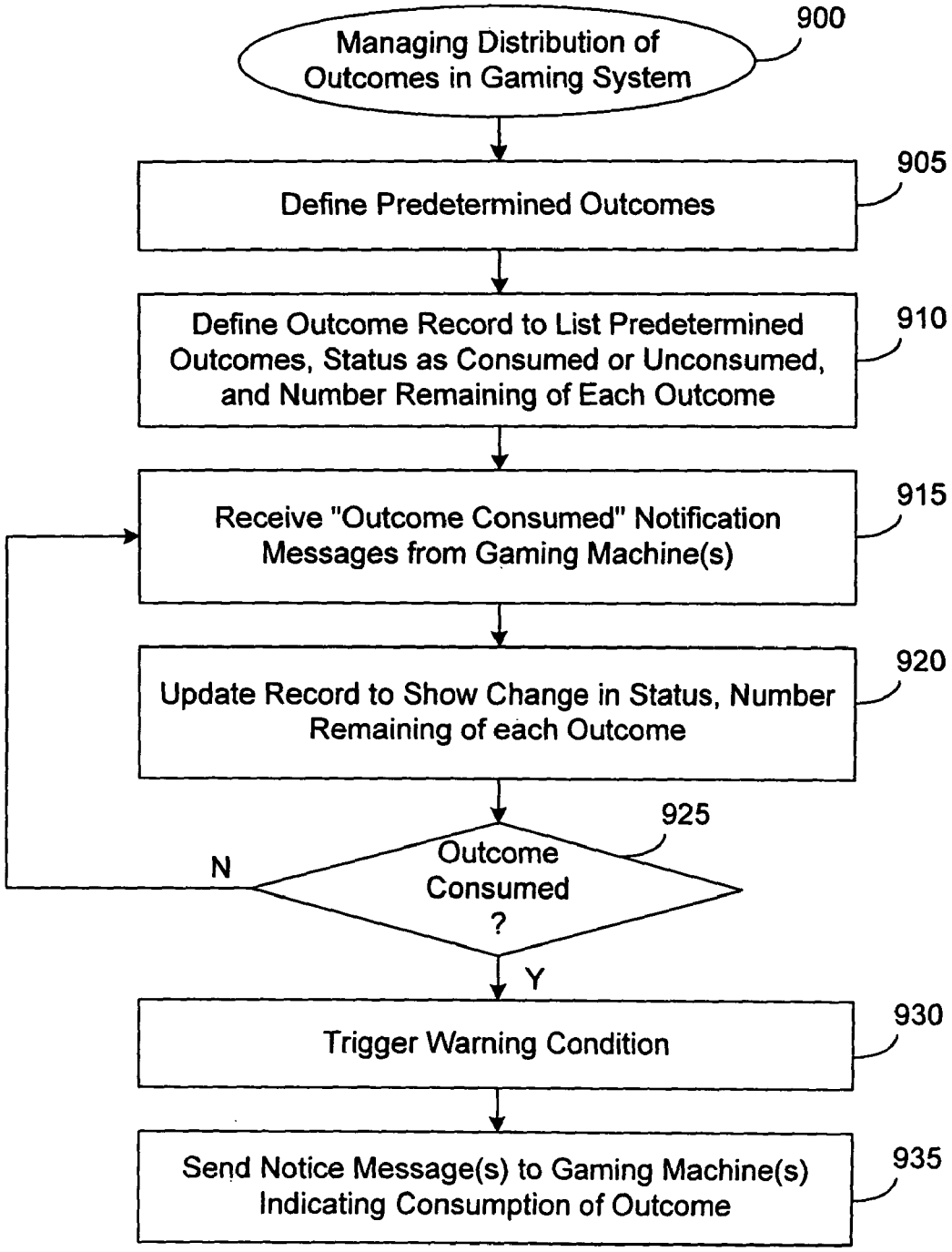
FIG. 9 shows a flow diagram of a method 900 for managing the distribution of outcomes in a gaming system, performed in accordance with one embodiment of the present invention.

FIG. 8 shows a storage medium 120 constructed according to one embodiment of the present invention. In storage medium 120 is a finite pool of outcomes 805 as described above. FIG. 9 shows a method 900 for managing the distribution of outcomes in a gaming system, and is described with respect to FIG. 8. The method 900 of FIG. 9 is applicable to other embodiments of gaming systems described herein.

In FIGS. 8 and 9, a pool 805 includes outcomes 1-N, defined in step 905 as shown. In one embodiment, a predetermined number of each outcome is defined, taking into account the award amounts required to meet desired payback percentages. These outcomes are listed in outcome record 815. In this embodiment, the storage medium 120 further includes recording unit 210, described above, and a notice unit 820. In another embodiment, the recording unit 210 and notice unit 820 are situated external to the storage medium 120, for example, in distributing computer 105 of FIG. 7.

Those skilled in the art will appreciate that the recording unit 210 and notice unit 820 can be implemented using various hardware and software configurations to realize the methods described herein.

In FIGS. 8 and 9, in step 910, recording unit 210 maintains an outcome record 815 which, in one embodiment, is defined to list the predetermined outcomes of step 905. In addition, in step 910, the outcome record 815 further includes a status indicator for each outcome, e.g., "consumed" or "not consumed," indicating which outcomes 1-N have been consumed by the various gaming machines coupled to data network 110. In one embodiment, a predetermined amount of each outcome can be consumed and, accordingly, record 815 is further defined to include a number remaining for each outcome, that is, how many of that outcome have not yet been consumed. In an alternative embodiment, the record maintains a tally of the number of each outcome consumed.

In one embodiment, such as system 700 of FIG. 7, gaming machines 715*a* and 715*b* coupled to the data network include outcome generators 215*a* and 215*b* to randomly produce outcomes within an allowed range of outcomes, as described above. Initially, all of the predetermined outcomes defined in step 905 are allowed. In step 915 of FIG. 9, as individual outcomes are generated and consumed by any of the various gaming machines, the gaming machines send notification messages over the data network to the recording unit 210. In step 920, responsive to receiving these notification messages, the recording unit 210 then updates the pool. That is, the recording unit 210 updates outcome record 815 to show which outcomes have been consumed by the various gaming machines in the network, and the field in the "number remaining" column for each outcome, as shown in FIG. 8. In step 925, as long as none of the outcomes have been consumed, the method repeats steps 915 and 925 as further notification messages are received.

In one embodiment, as mentioned above, a predetermined amount of each outcome can be consumed, and the record maintains a tally of the number of each outcome remaining or, alternatively, consumed. In step 925 of FIG. 9, when an outcome is completely consumed, that is, the predetermined amount of that outcome has been reached, a warning condition is triggered, in step 930. Responsive to this warning condition, in step 935, notice unit 820 sends a notice message to the gaming machines over the data network. This notice message indicates that the particular winning or losing outcome has been entirely consumed, and is no longer available. Responsive to receiving this notice message, the gaming machine(s) will no longer provide the particular winning or losing outcome for game play, even if generated by the outcome generator units situated in those machines, until receiving further instructions from the notice unit 820.

In one method, performed in accordance with the system 200 shown in FIG. 2, the distributing gaming machine 205 generates a plurality of outcomes to define a pool. The pool is stored in storage medium 120. The distributing gaming machine 205 then broadcasts a "pool available" message to the gaming machines 135*a-c* on the data network 110 that the machine 205 has the pool available for use. Responsive to receiving the pool available message, the distributing gaming machines can request individual outcomes from the finite pool for consumption, or, in another embodiment, can request a subset of the finite pool of outcomes as a sub-pool 125*a* of outcomes for local storage at the gaming machine 115*a* in a suitable storage medium.

Figure 10:
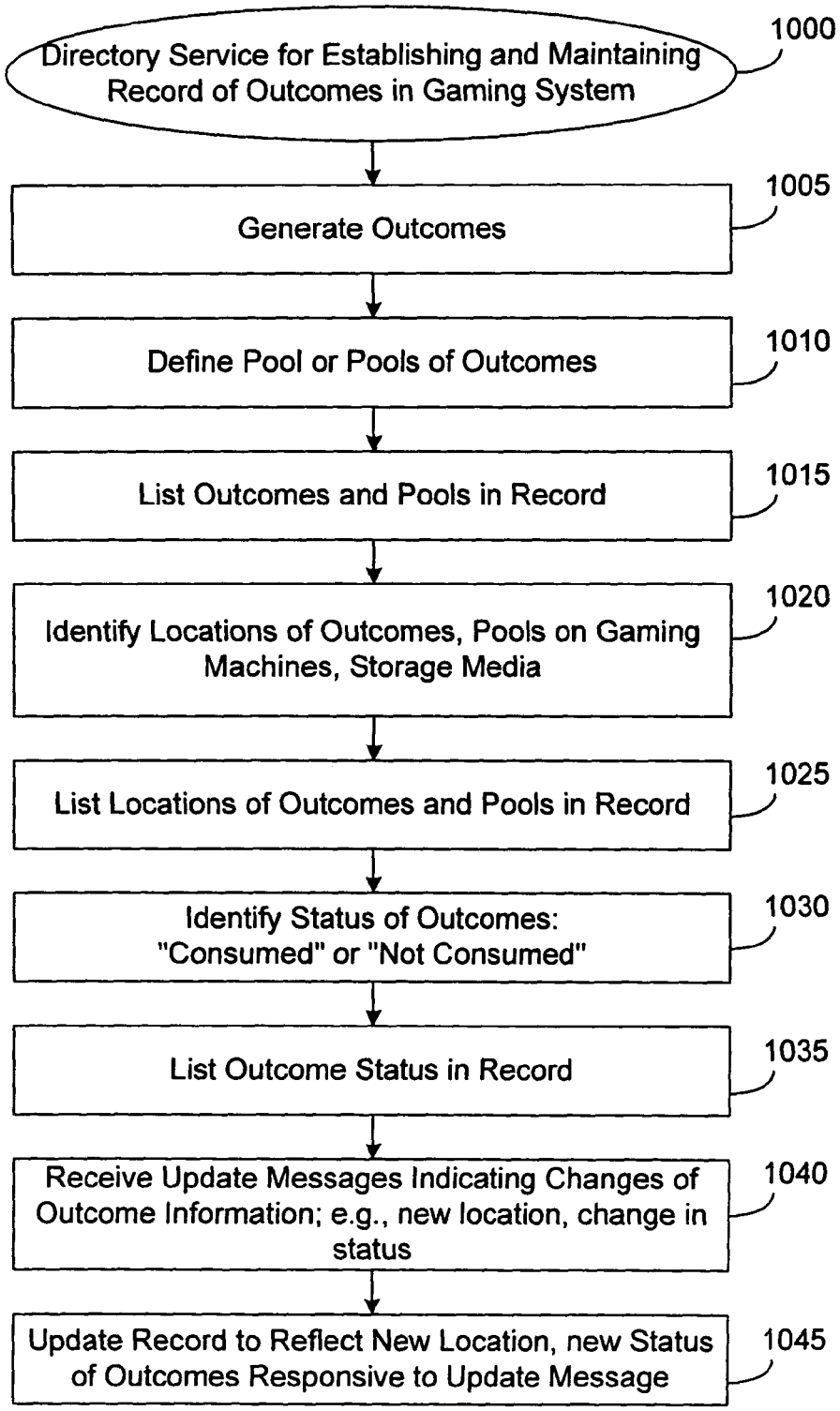
FIG. 10 shows a flow diagram of a method 1000 of a directory service for establishing and maintaining a record of outcomes in a gaming system, performed in accordance with one embodiment of the present invention.

FIG. 10 shows a method 1000 of a directory service for establishing and maintaining a record of outcomes in a gaming system, performed in accordance with one embodiment of the present invention. The method 1000 is applicable to the various gaming system embodiments described herein. In some embodiments, the method 1000 is often performed by recording unit 210 which can be situated in directory service unit 402, in various gaming machines, or as a stand-alone apparatus, as described above.

In FIG. 10, processing begins in step 1005 in which game outcomes are generated by any of a variety of techniques, as described herein or otherwise known to those skilled in the art. In step 1010, a pool or pools, including sub-pools, of those outcomes are defined as described herein. In step 1015, the record for tracking the outcomes receives data describing the outcomes, for example, in the form of a list. Examples of this record include record 410, described above with reference to FIG. 4 and record 730, described above with reference to FIG. 7.

In FIG. 10, in step 1020, processing continues with the identification of locations for the various outcomes, sub-pools and pools of the outcomes on the gaming machines or various storage mediums in the particular gaming system, as shown in records 410 and 730. As described herein, outcomes and pools of outcomes can be situated on various apparatus, and can be retrieved and exchanged as desired for the particular implementation. Using the record, the recording unit 210 tracks the locations of these outcomes as they are moved from location to location. In one example, when the outcomes are initially generated by outcome generator unit 215, and stored in an appropriate storage medium, this storage medium is identified as the initial location for the various outcomes. Then, as the outcomes are grouped into pools and moved to different storage mediums or various gaming machines, the list is updated accordingly to reflect the new location.

In FIG. 10, in step 1025, the identified locations of the outcomes and pools are listed in the record, for example, as shown in record 410 of FIG. 4 and record 730 of FIG. 7. In step 1030, the status of the various outcomes is identified in the record. This status, in one embodiment, indicates whether the particular outcome or pool of outcomes has been consumed or not, as shown in record 815 of FIG. 8. In one example, when the outcomes are initially generated and listed in the record, in step 1015, before being distributed or otherwise available to be used by the gaming machines, the initial status of all the outcomes is "not consumed." In step 1035, the status of the various outcomes and pools is recorded in the record, for example, as shown in record 730 of FIG. 7.

In FIG. 10, in step 1040, when outcomes begin to change locations and be used, update messages are sent from the various apparatus to the recording unit 210 indicating the change of information, for example, the new location or change in status for the particular outcome or pool of outcomes. As mentioned above, these update messages can take various forms in accordance with embodiments of the present invention. In one embodiment, the update message lists the particular outcome, an indication of the particular field to be updated, such as location or status, and the new information for that field, for example, a different gaming machine on which the outcome resides. In another embodiment, the outcome itself is passed to the recording unit 210 or other unit or apparatus in which recording unit 210 is situated before being transferred to the new location. In this way, the recording unit 210 updates the record by intercepting the outcome itself. In another embodiment, when an outcome is consumed, the gaming machine or other apparatus at which the outcome is consumed sends an appropriate update message to recording unit 210 indicating that the status information should be updated for that outcome to show "consumed." In FIG. 10, in step 1045, the record is updated to reflect the new location or other new status information of the outcomes responsive to receiving the update message of step 1040.

Figure 11:
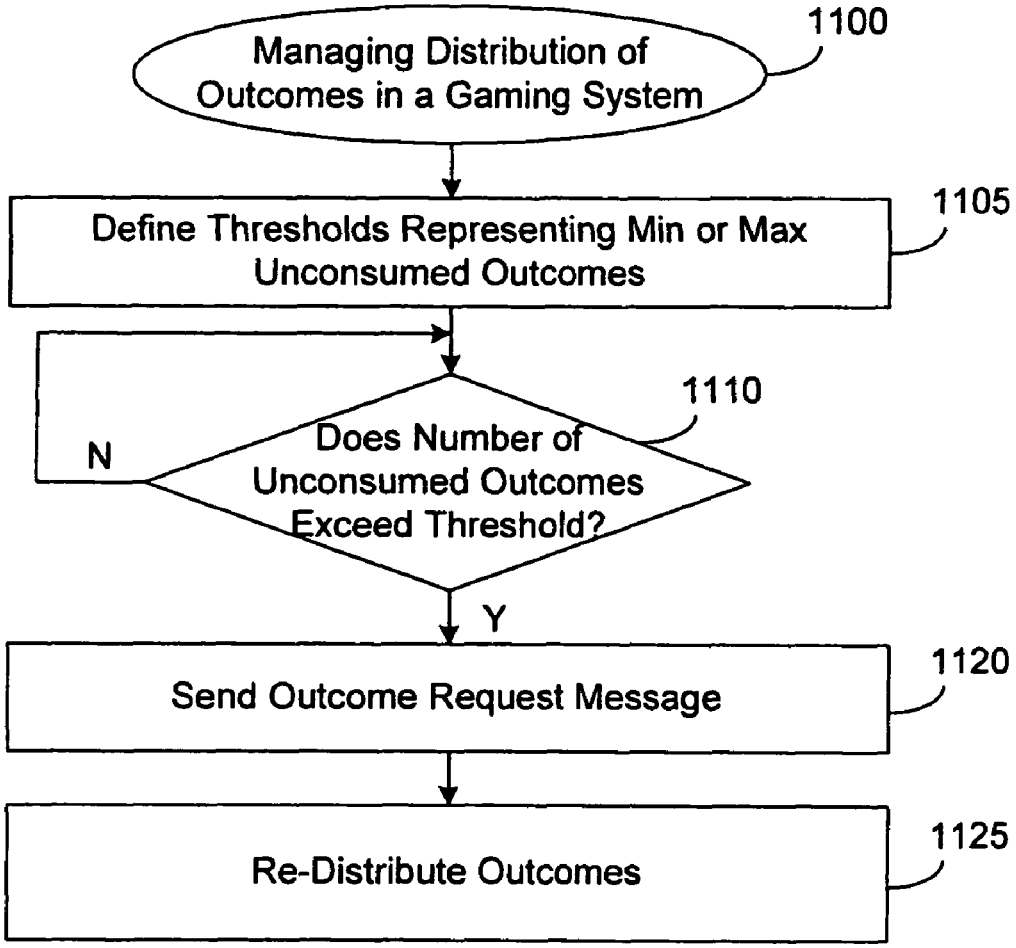
FIG. 11 shows a flow diagram of a method 1100 for managing the distribution of outcomes in a gaming system, performed in accordance with one embodiment of the present invention.

FIG. 11 shows a method 1100 for managing the distribution of outcomes in a gaming system, performed in accordance with one embodiment of the present invention. The method 1100 is applicable to the various gaming system embodiments described herein and illustrated in the Figs. In some embodiments, the method 1100 is performed by distributing computer 105 of FIGS. 1, 2, 5 and 7. In other embodiments, the method 1100 is performed by a distributing unit 220 coupled to data network 110, for instance, in the systems shown in FIGS. 3, 4, 6 and 8. Those skilled in the art should appreciate that this distributing unit 220 performing method 1100 can be coupled to data network 110 as a standalone apparatus or, in another embodiment, situated within one of the gaming machines coupled to data network 110.

In FIG. 11, the method begins in step 1105 with the defining of thresholds for unconsumed outcomes. Thresholds are defined for one or more of the gaming machines in the system. In one embodiment, one threshold represents a minimum number of unconsumed outcomes for a particular gaming machine at any given time. In another embodiment, a threshold is defined to represent a maximum number of unconsumed outcomes for a given gaming machine. In this way, the thresholds can be used to ensure that proper load balancing is performed over a period of time. For example, certain gaming machines in the system may be more heavily used than others, for various reasons. Defining thresholds of unconsumed outcomes for such gaming machines ensures that outcomes are provided on those gaming machines to meet demand for game play. By the same token, less frequently used gaming machines need not have an unnecessarily large pool of unconsumed outcomes. The threshold can be different from one gaming machine to the next, and can be set depending on the use of the particular gaming machine. In one example, a threshold for a particular gaming machine in the network is defined as a constant C times the average games per day, or per hour, minute, etc., that are played on the machine. Thus, for example, a gaming machine in a popular location that is played twice as much as a machine in a less popular location can have thresholds twice as high as the machine in the less popular location.

In FIG. 11, in step 1110, the method continues with the determination of when a number of unconsumed outcomes distributed to one of the gaming machines is less than the minimum number of outcomes or more than the maximum number of outcomes defined by the threshold for that gaming machine. For example, a gaming machine known to be heavily used has a threshold defined in step 1105 of a minimum number of 100 outcomes to be distributed to that gaming machine. In step 1110, it is determined whether this minimum has been reached. On another gaming machine, for which a maximum number of outcomes has been defined by the threshold, step 1110 involves determining whether the number of actual distributed outcomes to that gaming machine is greater than the defined threshold.

In FIG. 11, in step 1120, when the threshold has been exceeded in either a minimum or maximum context, as described above, an outcome request message is sent. The outcome request message indicates that a transfer of outcomes is needed. In one example, for a gaming machine at which there are fewer outcomes than the minimum number defined by the threshold, the outcome request message requests the delivery of more outcomes to that gaming machine. The outcome request message can be sent to the distributing computer 105 or other gaming machines coupled to the network, requesting that the computer or gaming machines send one or more outcomes to the requesting gaming machine. In another example, for a gaming machine at which there are more outcomes than the predefined maximum of the threshold for that gaming machine, the request message requests the transfer of outcomes from that gaming machine to other gaming machines or the distributing computer of the system.

In FIG. 11, in step 1125, responsive to receiving the outcome request message, the outcomes are redistributed as needed. For example, when outcomes are needed by the gaming machine sending the request message, one or more of the other gaming machines on the network 110 or distributing computer send outcomes to the requesting gaming machine. Or, alternatively, when there are more outcomes at the gaming machine than the maximum of the predefined threshold, other gaming machines or the distributing computer identify themselves to the requesting gaming machine as being available to receive outcomes. The requesting gaming machine then sends the outcomes to those gaming machines or distributing computer.

In FIG. 11, the method 1100 of managing the distribution of outcomes uses the information maintained in the record of recording unit 210 to easily track the location and status of the various outcomes defined in the system. As the record is updated, the determining step 1110 of FIG. 11 can be made to identify an appropriate time for redistribution of those outcomes.

The recording unit 210 provides several benefits for the gaming systems and methods described herein. By maintaining records such as record 410 shown in FIG. 4 and record 730 shown in FIG. 7, the recording unit enables the exchange of outcomes between gaming machines in the system. For example, not only can a gaming machine easily access its own pool or sub-pool of outcomes, but can just as easily request outcomes from a distributing computer, such as distributing computer 105 of FIG. 1, or another gaming machine in the network, in any of the various gaming systems described herein. As outcomes are moved from location to location, the recording unit updates the record using techniques described herein.

In another embodiment, when distributed outcomes remain at a gaming machine and are unconsumed for a predetermined period of time, or when a maximum number of outcomes are provided to the gaming machine, those outcomes are transferred back to the distributing computer or distributing gaming machine using techniques described above. That is, outcomes are sent back to the distributing computer rather than being transferred directly to other gaming machines. The gaming machine sends a report message back to the distributing computer indicating the particular outcomes which have not been consumed, e.g., 3 instances of winning outcome X, 4 instances of losing outcome Y, etc. Records are updated accordingly as to the status of those outcomes and new location at the distributing computer or distributing gaming machine, as explained above. Accounting data is updated, for instance, crediting the establishment or the gaming machine. In some embodiments, the distributing computer then re-distributes the outcomes to other gaming machines in the network.

In a peer-to-peer system, preferably each gaming machine is accountable for its own outcomes. For instance, in one implementation, a first gaming machine in the system sends an accounting message it received 1,000 outcomes and is responsible for $100 of income. When a second gaming machine runs out of outcomes, the second gaming machine sends a request for outcomes. Responsive to the second gaming machine request message, the first gaming machine determines that its threshold has been exceeded and, therefore, has outcomes to distribute. The first gaming machine sends a response message to the second gaming machine indicating that the first gaming machine can provide 200 of its 1,000 outcomes. The first gaming machine sends the 200 outcomes to the second gaming machine, adjusting the respective pools at those machines. The second gaming machine then adjusts its accounting meters that the second gaming machine is responsible for an additional 200 outcomes, i.e. $20 of outcomes. The first gaming machines adjusts its accounting meters to indicate that the first gaming machine is responsible for $20 less of outcomes.

In implementing methods and systems according to the present invention, in some embodiments, meters are provided in the individual gaming machines in the gaming machine network. The meters are preferably implemented in hardware and/or combinations of software and hardware. The meters track, for instance, amount of money received, number of coins received, number of games played, number of coins played, number of games won, number of coins won, amount of money won, overall game percentage, number of door opens, number of critical tilts issued, number of bills accepted, etc. These meters can be accessed remotely, often through a casino slot accounting system ("SAS"), or directly at the gaming machine, and verified to ensure that the desired payback percentages have been achieved.

Generally, players can use the gaming methods and systems described herein by purchasing game plays or sessions through any of the various gaming machines of the gaming system. Players can purchase one or more outcomes, sub-pools of outcomes, and pools of outcomes as desired and permitted by the particular gaming system. Each player can purchase outcomes from the pool(s), e.g., by initiating game plays. In some embodiments, the gaming machines incorporate input devices operable by players to request, often by purchase, outcomes stored at any of the various locations described above. Players can proceed with playing games on the gaming machines by purchasing outcomes through the gaming machines.

Generally, the gaming machines provide player interfaces to the various gaming systems described herein. Each gaming machine receives and processes player input, including game play requests from the players. A gaming machine constructed according to embodiments of the present invention monitors a player's game play progress, including winnings. The gaming machine includes devices, described below, configured to receive and store a player's wagers. The gaming machine is coupled to detect when game play requested by a player involves receiving a winning outcome. The gaming machine generally incorporates a display to show the amount of the winning outcome.

Software is generally implemented throughout the gaming system to provide the pools of outcomes and to coordinate the methods described herein and other processing steps for the gaming system to be operable, as will be understood by those skilled in the art. Suitable apparatus is provided for generating the outcomes in a format suitable for the games provided to the players on the gaming machines. In some embodiments, the outcomes provided in the pools and sub-pools include a predetermined number of winning outcomes. In one implementation, this predetermined number is set at the generation of the outcomes. In some embodiments, software is provided on the gaming machines to indicate to a player the number of winning outcomes purchased thus far by the player.

Some games of the present invention can be implemented, in part, in a gaming device such as the gaming machines described herein according to game data received from a game server, such as the distributing computers, distributing machines and distributing units described herein. The gaming device may receive such game data through data network 110, such as a dedicated gaming network and/or a public data network such as the Internet.

Figure 12:
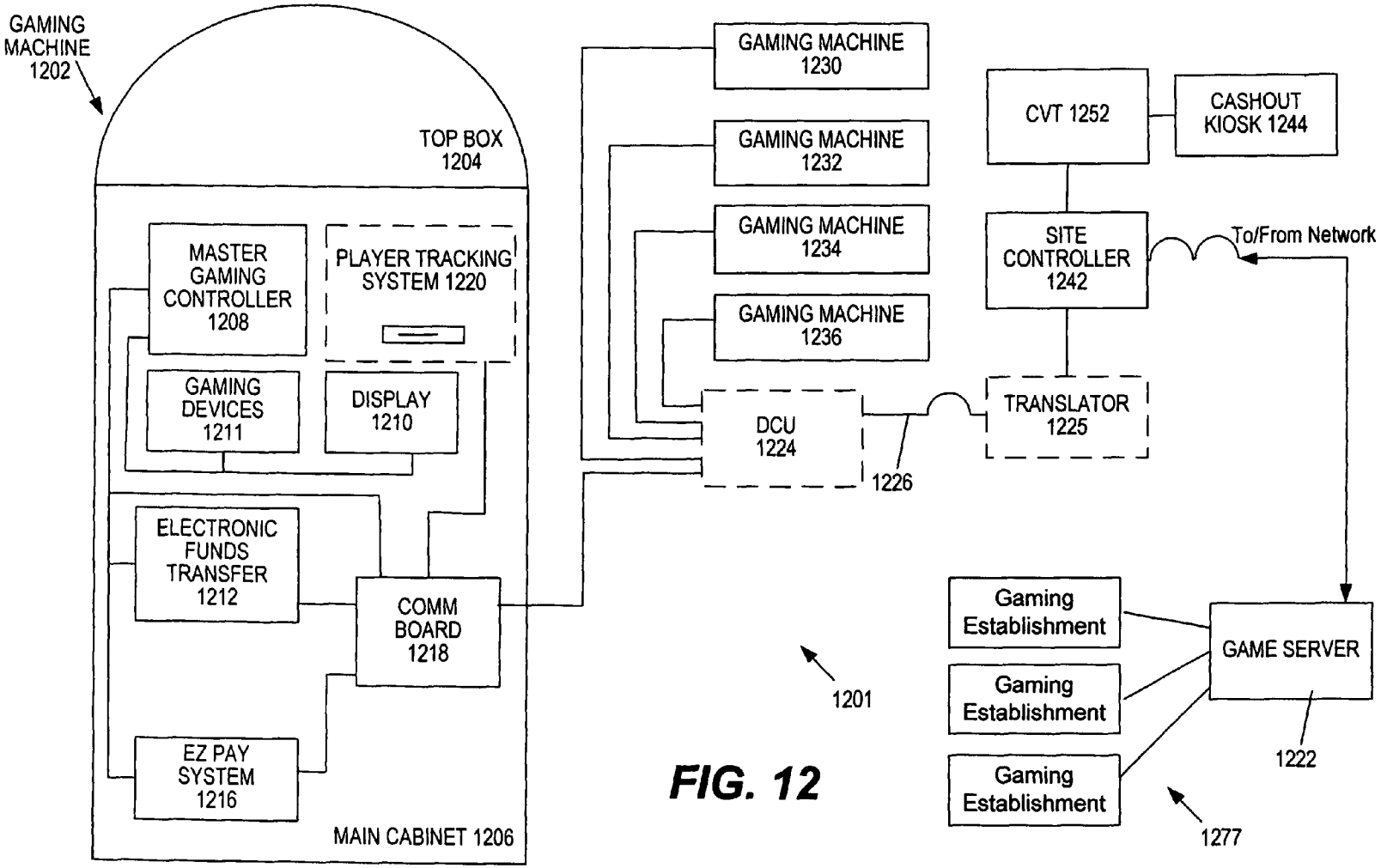
FIG. 12 is a block diagram of a number of gaming machines in a gaming network, constructed according to one embodiment of the present invention, that may be configured to implement some methods of the present invention.

One example of a gaming system, also referred to herein as a gaming network, that may be used to implement methods performed in accordance with embodiments of the invention is depicted in FIG. 12. Gaming establishment 1201 could be any sort of gaming establishment, such as a casino, a card room, an airport, a store, etc. In this example, gaming network 1277 includes more than one gaming establishment, all of which are networked to game server 1222.

Here, gaming machine 1202, and the other gaming machines 1230, 1232, 1234, and 1236, include a main cabinet 1206 and a top box 1204. The main cabinet 1206 houses the main gaming elements and can also house peripheral systems, such as those that utilize dedicated gaming networks. The top box 1204 may also be used to house these peripheral systems.

The master gaming controller 1208 controls the game play on the gaming machine 1202 according to instructions and/or game data from game server 1222 and receives or sends data to various input/output devices 1211 on the gaming machine 1202. In one embodiment, master gaming controller 1208 includes a processor and an independent game logic module. The master gaming controller 1208 may also communicate with a display 1210.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1208 may also communicate with EFT system 1212, EZPay™ system 1216 (a proprietary cashless ticketing system of the present assignee), and player tracking system 1220. The systems of the gaming machine 1202 communicate the data onto the network 1222 via a communication board 1218.

It will be appreciated by those of skill in the art that the present invention could be implemented on a network with more or fewer elements than are depicted in FIG. 12. For example, player tracking system 1220 is not a necessary feature of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment.

Moreover, DCU 1224 and translator 1225 are not required for all gaming establishments 1201. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1242 provides this function for gaming establishment 1201. Site controller 1242 is connected to a central system and/or other gaming establishments via one or more networks, which may be public or private networks. Among other things, site controller 1242 communicates with game server 1222 to obtain game data, such as ball drop data, bingo card data, etc.

In the present illustration, gaming machines 1202, 1230, 1232, 1234 and 12736 are connected to a dedicated gaming network 1222. In general, the DCU 1224 functions as an intermediary between the different gaming machines on the network 1222 and the site controller 1242. In general, the DCU 1224 receives data transmitted from the gaming machines and sends the data to the site controller 1242 over a transmission path 1226. In some instances, when the hardware interface used by the gaming machine is not compatible with site controller 1242, a translator 1225 may be used to convert serial data from the DCU 1224 to a format accepted by site controller 1242. The translator may provide this conversion service to a plurality of DCUs.

Further, in some dedicated gaming networks, the DCU 1224 can receive data transmitted from site controller 1242 for communication to the gaming machines on the gaming network. The received data may be, for example, communicated synchronously to the gaming machines on the gaming network.

Here, CVT 1252 provides cashless and cashout gaming services to the gaming machines in gaming establishment 1201. Broadly speaking, CVT 1252 authorizes and validates cashless gaming machine instruments (also referred to herein as "tickets" or "vouchers"), including but not limited to tickets for causing a gaming machine to display a game result and cashout tickets. Moreover, CVT 1252 authorizes the exchange of a cashout ticket for cash. These processes will be described in detail below. In one example, when a player attempts to redeem a cashout ticket for cash at cashout kiosk 1244, cash out kiosk 1244 reads validation data from the cashout ticket and transmits the validation data to CVT 1252 for validation. The tickets may be printed by gaming machines, by cashout kiosk 1244, by a stand-alone printer, by CVT 1252, etc. Some gaming establishments will not have a cashout kiosk 1244. Instead, a cashout ticket could be redeemed for cash by a cashier (e.g. of a convenience store), by a gaming machine or by a specially configured CVT.

Figure 13:
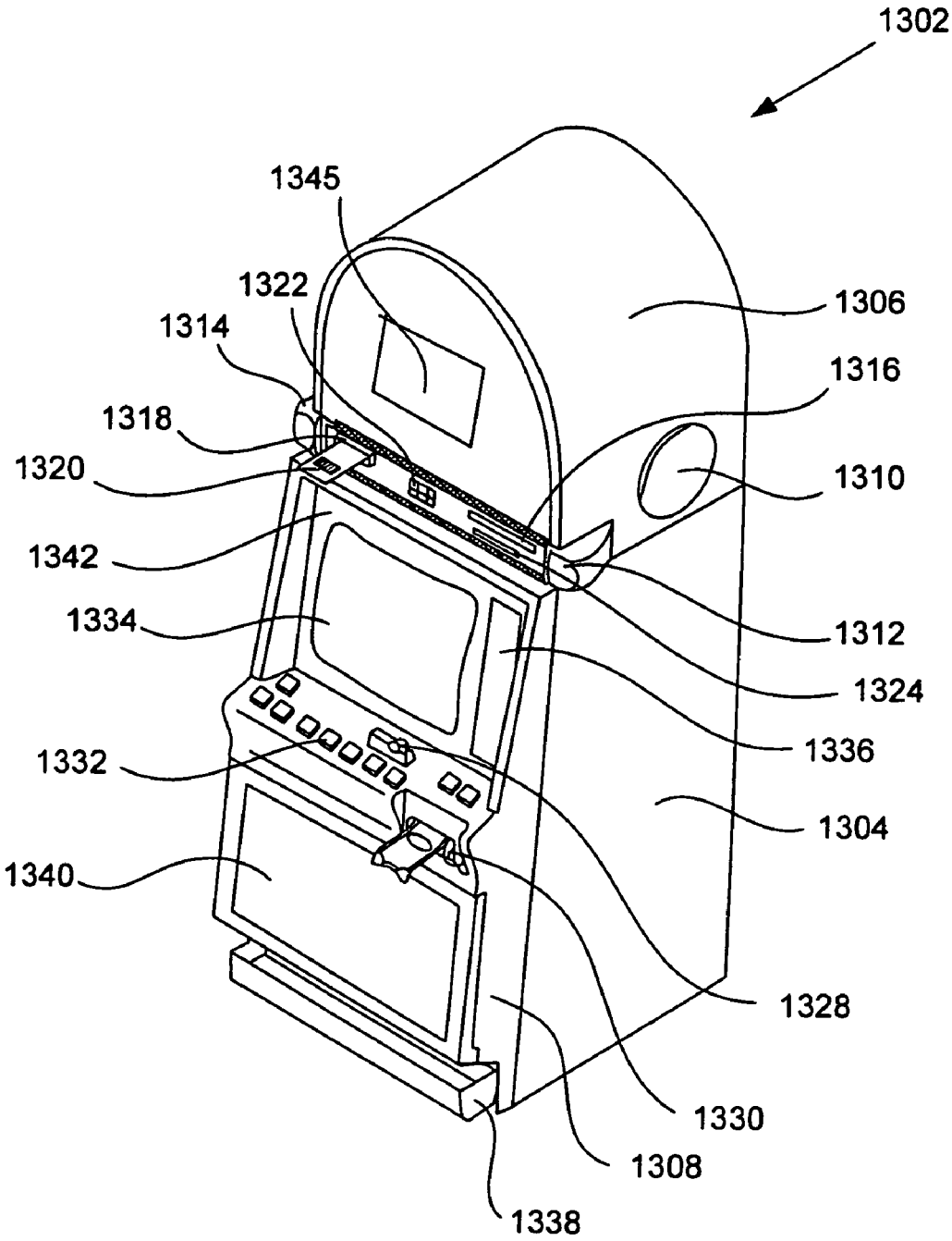
FIG. 13 illustrates a gaming machine, constructed according to one embodiment of the present invention, that may be configured to implement some methods of the present invention.

Turning to FIG. 13, more details of gaming machine 1202 are described. Machine 1202 includes a main cabinet 1304, which generally surrounds the machine interior (not shown) and is viewable by users. The main cabinet 1304 includes a main door 1308 on the front of the machine, which opens to provide access to the interior of the machine. Attached to the main door are player-input switches or buttons 1332, a coin acceptor 1328, and a bill validator 1330, a coin tray 1338, and a belly glass 1340. Viewable through the main door is a video display monitor 1334 and an information panel 1336. The display monitor 1334 will typically be a cathode ray tube, high resolution flat-panel LCD, or other conventional electronically controlled video monitor. The information panel 1336 may be a back-lit, silk screened glass panel with lettering to indicate general game information including, for example, the number of coins played. The bill validator 1330, player-input switches 1332, video display monitor 1334, and information panel are devices used to play a game on the game machine 1202. The devices are controlled by circuitry housed inside the main cabinet 1304 of the machine 1202.

The gaming machine 1202 includes a top box 1306, which sits on top of the main cabinet 1304. The top box 1306 houses a number of devices, which may be used to add features to a game being played on the gaming machine 1202, including speakers 1310, 1312, 1314, a ticket printer 1318 which may print bar-coded tickets 1320 used as cashless instruments. The player tracking unit mounted within the top box 1306 includes a key pad 1322 for entering player tracking information, a florescent display 1316 for displaying player tracking information, a card reader 1324 for entering a magnetic striped card containing player tracking information, a microphone 1343 for inputting voice data, a speaker 1342 for projecting sounds and a light panel 1344 for display various light patterns used to convey gaming information. In other embodiments, the player tracking unit and associated player tracking interface devices, such as 1316, 1322, 1324, 1342, 1343 and 1344, may be mounted within the main cabinet 1304 of the gaming machine, on top of the gaming machine, or on the side of the main cabinet of the gaming machine.

Understand that gaming machine 1202 is but one example from a wide range of gaming machine designs on which the present invention may be implemented. For example, not all suitable gaming machines have top boxes or player tracking features. Further, some gaming machines have two or more game displays—mechanical and/or video. Some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed. Moreover, some aspects of the invention may be implemented on devices which lack some of the features of the gaming machines described herein, e.g., workstation, desktop computer, a portable computing device such as a personal digital assistant or similar handheld device, a cellular telephone, etc. U.S. patent application Ser. No. 09/967,326, filed Sep. 28, 2001 and entitled "Wireless Game Player," is hereby incorporated by reference.

Returning to the example of FIG. 13, when a user wishes to play the gaming machine 1202, he or she inserts cash through the coin acceptor 1328 or bill validator 1330. In addition, the player may use a cashless instrument of some type to register credits on the gaming machine 1202. For example, the bill validator 1330 may accept a printed ticket voucher, including 1320, as an indicium of credit. As another example, the card reader 1324 may accept a debit card or a smart card containing cash or credit information that may be used to register credits on the gaming machine.

During the course of a game, a player may be required to make a number of decisions. For example, a player may vary his or her wager on a particular game, select a prize for a particular game, or make game decisions regarding gaming criteria that affect the outcome of a particular game (e.g., which cards to hold). The player may make these choices using the player-input switches 1332, the video display screen 1334 or using some other hardware and/or software that enables a player to input information into the gaming machine (e.g. a GUI displayed on display 1316).

During certain game functions and events, the gaming machine 1202 may display visual and auditory effects that can be perceived by the player. These effects add to the excitement of a game, which makes a player more likely to continue playing. Auditory effects include various sounds that are projected by the speakers 1310, 1312, 1314. Visual effects include flashing lights, strobing lights or other patterns displayed from lights on the gaming machine 1202, from lights behind the belly glass 1340 or the light panel on the player tracking unit 1344.

After the player has completed a game, the player may receive game tokens from the coin tray 1338 or the ticket 1320 from the printer 1318, which may be used for further games or to redeem a prize. Further, the player may receive a ticket 1320 for food, merchandise, or games from the printer 1318. The type of ticket 1320 may be related to past game playing recorded by the player tracking software within the gaming machine 1202. In some embodiments, these tickets may be used by a game player to obtain game services.

IGT gaming machines are implemented with special features and/or additional circuitry that differentiate them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware components, software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA RS232 serial interfaces provided by general-purpose computers. These interfaces may include EIA RS485, EIA RS422, Fiber Optic Serial, Optically Coupled Serial Interfaces, current loop style serial interfaces, etc. In addition, to conserve serial interfaces internally in the slot machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the trusted memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Gaming machines used for Class III games generally include software and/or hardware for generating random numbers. However, gaming machines used for Class II games may or may not have RNG capabilities. In some machines used for Class II games, RNG capability may be disabled.

Figure 14:
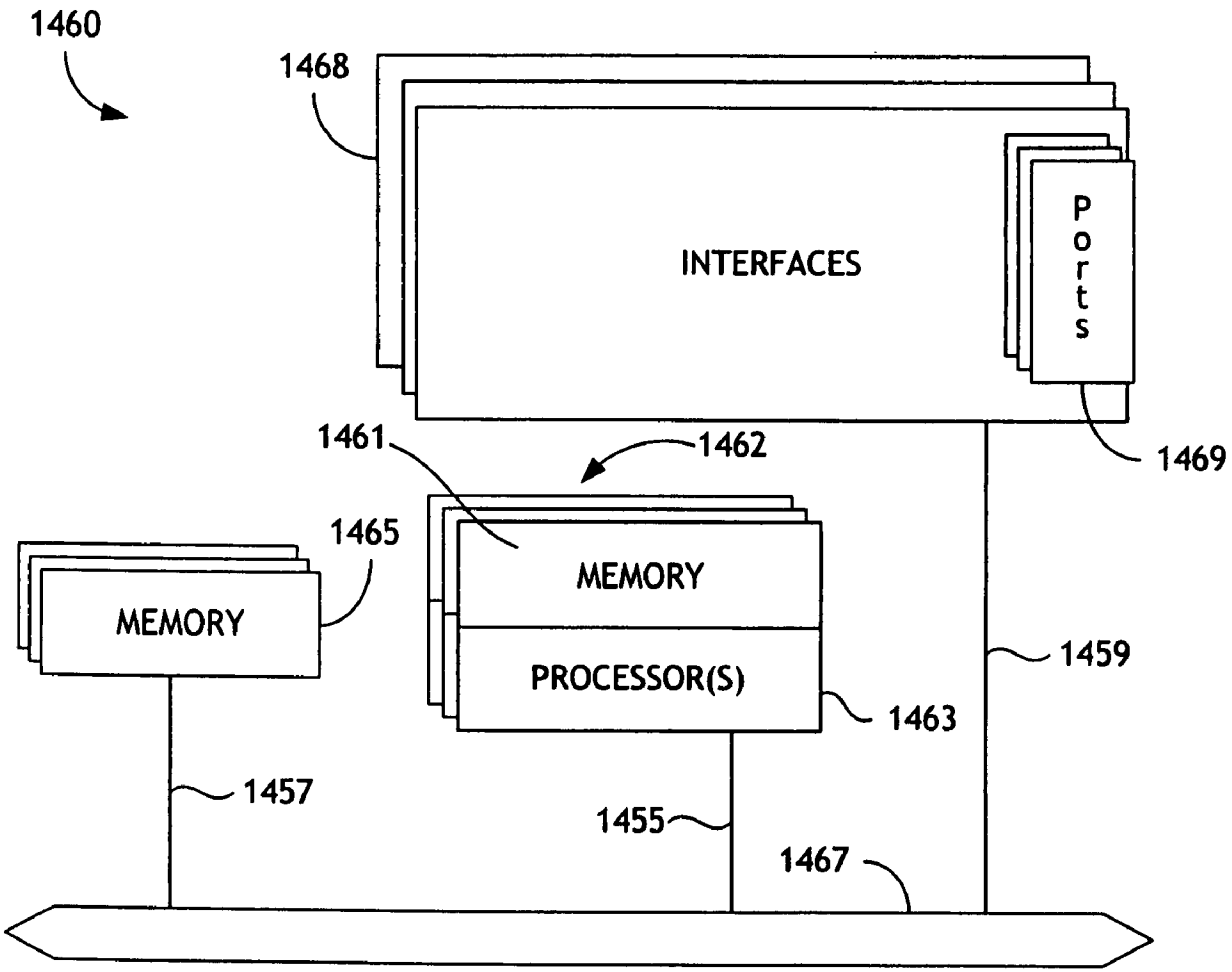
FIG. 14 is a block diagram of an exemplary network device, constructed according to one embodiment of the present invention, that may be configured as a game server to implement some methods of the present invention.

FIG. 14 illustrates an example of a network device that may be configured as a distributing computer, distributing machine, distributing unit, or other game server for implementing some methods of the present invention. Network device 1460 includes a master central processing unit (CPU) 1462, interfaces 1468, and a bus 1467 (e.g., a PCI bus). Generally, interfaces 1468 include ports 1469 appropriate for communication with the appropriate media. In some embodiments, one or more of interfaces 1468 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1468 control such communications-intensive tasks as media control and management. By providing separate processors for the communications-intensive tasks, interfaces 1468 allow the master microprocessor 1462 efficiently to perform other functions such as routing computations, network diagnostics, security functions, etc.

The interfaces 1468 are typically provided as interface cards (sometimes referred to as "linecards"). Generally, interfaces 1468 control the sending and receiving of data packets over the network and sometimes support other peripherals used with the network device 1460. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1462 may be responsible for implementing specific functions associated with the functions of a desired network device. According to some embodiments, CPU 1462 accomplishes all these functions under the control of software including an operating system and any appropriate applications software.

CPU 1462 may include one or more processors 1463 such as a processor from the Motorola family of microprocessors or the MIPS family of microprocessors. In an alternative embodiment, processor 1463 is specially designed hardware for controlling the operations of network device 1460. In a specific embodiment, a memory 1461 (such as non-volatile RAM and/or ROM) also forms part of CPU 1462. However, there are many different ways in which memory could be coupled to the system. Memory block 1461 may be used for a variety of purposes such as, for example, caching and/or storing data, programming instructions, etc.

Regardless of network device's configuration, it may employ one or more memories or memory modules (such as, for example, memory block 1465) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 14 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 14) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although the foregoing invention has been described in some detail for purposes of clarity of understanding, it will be apparent that certain changes and modifications may be practiced within the scope of the appended claims.

What is claimed is:

1. A gaming system comprising a plurality of gaming machines coupled to a data network, the plurality of gaming machines including a distributing gaming machine having a finite pool of outcomes stored on a storage medium accessible by the distributing gaming machine, the distributing gaming machine coupled to distribute game outcomes from the finite pool of outcomes over the data network, and a plurality of receiving gaming machines each coupled to receive one or more of the distributed outcomes over the data network, the distributing and receiving gaming machines operable for game play to consume the outcomes, and the distributing gaming machine operable to do the following:

associate a minimum threshold with one or more of the gaming machines, each minimum threshold representing a minimum number of unconsumed outcomes for the respective gaming machine, and each minimum threshold based on an average number of games played on the respective gaming machine in a defined length of time;

determine when a number of unconsumed outcomes distributed to a first gaming machine of the one or more gaming machines is less than the minimum threshold associated with the first gaming machine;

send an outcome request message over the data network when the number of unconsumed outcomes distributed to the first gaming machine is less than the minimum threshold;

receive, responsive to the outcome request message, a further one of the distributed outcomes;

send the received further one of the distributed outcomes to the first gaming machine;

define a maximum threshold for one or more of the gaming machines, each maximum threshold representing a maximum number of unconsumed outcomes for a third gaming machine, and each maximum threshold based on an average number of games played on the third gaming machine in a defined length of time;

determine when a number of unconsumed outcomes distributed to the third gaming machine is greater than the maximum threshold defined for the third gaming machine;

send an outcome request message over the data network when the number of unconsumed outcomes distributed to the third gaming machine is greater than the maximum threshold, wherein the outcome request message requests transfer of at least one of the unconsumed outcomes from the third gaming machine to a fourth gaming machine of the plurality of gaming machines or to a distributing computer coupled to the data network, and wherein the fourth gaming machine or the distributing computer identifies itself to the third gaming machine as being available to receive outcomes; and send the at least one of the unconsumed outcomes to the fourth gaming machine or the distributing computer in response to the outcome request message.

2. The gaming system of claim 1, further comprising a recording unit coupled to maintain a record of the outcomes distributed to the gaming machines and the outcomes remaining in the finite pool.

3. The gaming system of claim 1, wherein the distributed outcomes received on one of the gaming machines defines a sub-pool of the finite pool of outcomes.

4. The gaming system of claim 1, wherein each outcome includes an indication of a winning or losing game outcome.

5. The gaming system of claim 1, wherein each outcome includes an award amount.

6. A method for managing distribution of outcomes in a gaming system including a plurality of gaming machines coupled to a data network, a finite pool of outcomes distributed among the gaming machines, each outcome having a status of consumed or unconsumed, one of the gaming machines coupled to receive one or more of the distributed outcomes from others of the gaming machines over the data network, a further one of the gaming machines coupled to send one or more of the distributed outcomes to the one gaming machine over the data network, and operable for game play to consume the distributed outcomes, the method comprising the steps of:

associating a minimum threshold with one or more of the gaming machines, each minimum threshold representing a minimum number of unconsumed outcomes for the respective gaming machine, and each minimum threshold based on an average number of games played on the respective gaming machine in a defined length of time;

determining when a number of unconsumed outcomes distributed to one of the gaming machines is less than the minimum threshold associated with the one gaming machine;

sending an outcome request message, when the number of unconsumed outcomes distributed to the one gaming machine is less than the minimum threshold;

retrieving, responsive to the outcome request message, a further one of the distributed outcomes;

sending the retrieved outcome to the one gaming machine;

defining a maximum threshold for one or more of the gaming machines, each maximum threshold representing a maximum number of unconsumed outcomes for a third gaming machine, and each maximum threshold based on an average number of games played on the third gaming machine in a defined length of time;

determining when a number of unconsumed outcomes distributed to the third gaming machine is greater than the maximum threshold defined for the third gaming machine;

sending an outcome request message over the data network when the number of unconsumed outcomes distributed to the third gaming machine is greater than the maximum threshold, wherein the outcome request message requests transfer of at least one of the unconsumed outcomes from the third gaming machine to a fourth gaming machine of the plurality of gaming machines or to a distributing computer coupled to the data network, and wherein the fourth gaming machine or the distributing computer identifies itself to the third gaming machine as being available to receive outcomes; and sending the at least one of the unconsumed outcomes to the fourth gaming machine or the distributing computer in response to the outcome request message.

7. The method of claim 6, wherein the defined length of time is a day, an hour, or a minute.

8. A method for managing distribution of outcomes in a gaming system including a plurality of gaming machines coupled to a data network, a finite pool of outcomes distributed among the gaming machines, each outcome having a status of consumed or unconsumed, one of the gaming machines coupled to receive one or more of the distributed outcomes from others of the gaming machines over the data network, a further one of the gaming machines coupled to send one or more of the distributed outcomes to the one gaming machine over the data network, and operable for game play to consume the distributed outcomes, the method comprising the steps of:

associating a maximum threshold with one or more of the gaming machines, each maximum threshold representing a maximum number of unconsumed outcomes for the respective gaming machine, and each maximum threshold based on an average number of games played on the respective gaming machine in a defined length of time;

determining when a number of unconsumed outcomes distributed to one of the gaming machines is greater than the maximum threshold associated with the one gaming machine;

sending an outcome request message over the data network when the number of unconsumed outcomes distributed to the one gaming machine is greater than the maximum threshold, wherein the outcome request message requests transfer of at least one of the unconsumed outcomes from the one gaming machine to a second gaming machine of the plurality of gaming machines or to a distributing computer coupled to the data network, and wherein the second gaming machine or the distributing computer identifies itself to the one gaming machine as being available to receive outcomes; and sending the at least one of the unconsumed outcomes to the second gaming machine or the distributing computer in response to the outcome request message.

9. The method of claim 8, wherein the defined length of time is a day, an hour, or a minute.

10. The gaming system of claim 1, wherein the distributing gaming machine is operable to send the outcome request message over the data network to a distributing computer, and to receive the further one of the distributed outcomes from the distributing computer.

11. The gaming system of claim 1, wherein the distributing gaming machine is operable to send the outcome request message over the data network to a second gaming machine, and to receive the further one of the distributed outcomes from the second gaming machine.

12. The gaming system of claim 1, wherein the minimum threshold is a constant value multiplied by the average number of games played per the defined length of time on the respective gaming machine.

13. The gaming system of claim 1, wherein the defined length of time is a day, an hour, or a minute.

14. The method of claim 8, wherein the maximum threshold is a constant value multiplied by the average number of games played per the defined length of time on the respective gaming machine.

* * * * *